US011408111B2

(12) United States Patent
Jung et al.

(10) Patent No.: US 11,408,111 B2
(45) Date of Patent: Aug. 9, 2022

(54) EASY-TO-OPEN STORAGE CONTAINER AND CLOTHES TREATING MACHINE INCLUDING THE SAME

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 16/748,398

(22) Filed: Jan. 21, 2020

(65) Prior Publication Data

US 2020/0232145 A1 Jul. 23, 2020

(30) Foreign Application Priority Data

Jan. 21, 2019 (KR) ..... 10-2019-0007670

(51) Int. Cl.
*D06F 39/02* (2006.01)
*D06F 39/06* (2006.01)

(52) U.S. Cl.
CPC ..... *D06F 39/02* (2013.01); *D06F 39/06* (2013.01)

(58) Field of Classification Search
CPC ..... D06F 39/02
See application file for complete search history.

(56) References Cited

U.S. PATENT DOCUMENTS

2007/0175898 A1* 8/2007 Craft ..... B65F 1/1615 220/324

FOREIGN PATENT DOCUMENTS

| | | |
|---|---|---|
| KR | 101461385 | 11/2014 |
| KR | 20170096314 | 8/2017 |
| WO | WO2010040674 | 4/2010 |

OTHER PUBLICATIONS

Office Action in German Appln. No. 102020200431, dated Sep. 16, 2021, 3 pages (English translation).

* cited by examiner

*Primary Examiner* — Jason Y Ko
(74) *Attorney, Agent, or Firm* — Fish & Richardson P.C.

(57) ABSTRACT

A storage container and a clothes treating machine including the same are described. The storage container is received in a detergent supply device and includes a cover portion including a cover rear protruding portion that protrudes outward from one side thereof. The storage container includes a detergent receiving portion including a container rear protruding portion that protrudes outward from one side thereof and that is aligned with the cover rear protruding portion. A user may grip the cover rear protruding portion provided in the cover portion to easily separate the cover portion and the detergent receiving portion. In addition, the user may grip the cover rear protruding portion and the container rear protruding portion to more easily separate the cover portion and the detergent receiving portion.

18 Claims, 21 Drawing Sheets

EASY-TO-OPEN STORAGE CONTAINER AND CLOTHES TREATING MACHINE INCLUDING THE SAME

CROSS-REFERENCE TO RELATED APPLICATION

Pursuant to 35 U.S.C. § 119(a), this application claims the benefit of an earlier filing date of and the right of priority to Korean Patent Application No. 10-2019-0007670, filed on Jan. 21, 2019, the contents of which are incorporated by reference herein in its entirety.

BACKGROUND

1. Technical Field

The present disclosure relates to a storage container and a clothes treating machine including the same, and more particularly, to a storage container having a structure capable of easily opening a storage container and a clothes treating machine including the same.

2. Description of the Related Art

The clothes treating machine is a device for washing clothes or treating clothes by physical and chemical methods to maintain a good condition of clothes. Furthermore, the clothes treating machine may be configured to also perform dry cleaning or the like.

In order to perform the above-described functions using the clothes treating machine, a separate material for treating clothes may need to be supplied to the clothes treating machine. In general, detergent or softener or the like may be supplied to the clothes treating machine in order to wash or treat clothes.

The clothes treating machine according to the related art generally has a structure in which detergent or softener is manually added to the clothes treating machine whenever the user operates the clothes treating machine.

Such a type of clothes treating machine has a problem that it is inconvenient to treat clothes because detergent or softener should be provided every time the user uses the clothes treating machine.

In order to solve the foregoing problem, in recent years, a clothes treating machine with a method capable of automatically adding detergent or softener has been developed and used.

Korean Patent Publication No. 10-1461385 discloses a washing machine having a large capacity detergent box. Specifically, it is disclosed a washing machine having a structure provided with a detergent box including a one-time compartment and a compartment such that detergent added to the one-time compartment is all used, and detergent added to the compartment may remain above a predetermined amount.

However, according to a washing machine having such a structure, detergent added to the one-time compartment does not remain because it is all used during the operation of the washing machine, but detergent added to the compartment remains in the compartment while being exposed to the atmosphere even after being used by the washing machine.

Therefore, detergent adhered to the compartment may cause hygiene and aesthetic problems, and there is also a limit that the possibility of contamination of detergent or softener cannot be excluded.

Korean Patent Publication No. 10-2017-0096314 discloses a washing machine having a detergent box capable of being detachably coupled to a detergent box. Specifically, the present disclosure discloses a structure related to a detergent box including a mounting groove portion mounted with a detergent compartment in which detergent in the form of powder is contained and a detergent box in which liquid detergent is contained.

However, this type of detergent box has a disadvantage in that it is difficult to distinguish detergent that is automatically added or detergent that is manually added because the receiving method is different depending on the type of detergent.

In addition, liquid detergent received in the detergent box is physically isolated from the atmosphere, but detergent in the form of powder received in the detergent compartment is still exposed to the atmosphere. Therefore, there is a limit that it is difficult to prevent the contamination of detergent in the form of powder.

PRIOR ART DOCUMENTS

Patent Documents

Korea Patent No. 10-146138 (Nov. 13, 2014) Korean Patent Publication No. 10-2017-0096314 (Aug. 24, 2017)

SUMMARY

An aspect of the present disclosure is to provide a storage container having a structure capable of solving the foregoing problems and a clothes treating machine including the same.

First, an aspect of the present disclosure is to provide a storage container having a structure capable of receiving long-term automatic supply detergent or softener received on a detergent supply device in a separate container so as to prevent it from being exposed to the atmosphere, and a clothes treating machine including the same.

Furthermore, an aspect of the present disclosure is to provide a storage container having a structure capable of separately storing detergent or softener that is automatically added thereto, and a clothes treating machine including the same.

In addition, an aspect of the present disclosure is to provide a storage container having a structure capable of easily opening and closing the storage container in which detergent or softener that is automatically added thereto is received, and a clothes treating machine including the same.

Moreover, an aspect of the present disclosure is to provide a storage container having a structure capable of being efficiently received in a detergent supply device even when a member for easily opening and closing the storage container is provided, and a clothes treating machine including the same.

Besides, an aspect of the present disclosure is to provide a storage container having a structure in which members for easily opening and closing the storage container are provided at a plurality of sides to open and close the storage container in which detergent or softener is received, and a clothes treating machine including the same.

In order to achieve the foregoing objectives, the present disclosure may provide a storage container, including a detergent receiving portion configured to extend in a length direction to receive detergent or softener therein; and a cover portion configured to open or close the detergent receiving portion, wherein the cover portion includes a cover rear protruding portion disposed to protrude in a length direction of the cover portion from one side in the length direction of the cover portion so as to be gripped to open the cover portion.

Furthermore, the detergent receiving portion of the storage container may include a container rear protruding portion disposed to protrude in a length direction of the detergent receiving portion from one side of the length direction of the detergent receiving portion corresponding to one side of the length direction of the cover portion so as to be gripped to open the cover portion.

Furthermore, the cover rear protruding portion and the container rear protruding portion may be aligned with each other when the cover portion closes the detergent receiving portion.

Furthermore, a protruding length of the cover rear protruding portion may be disposed to be equal to or greater than that of the container rear protruding portion.

Furthermore, the cover portion of the storage container may include a flat portion that closes the detergent receiving portion; and a vertical surface portion that extends downward from an end portion of the flat portion, wherein the cover rear protruding portion is disposed to protrude from the vertical surface portion.

Furthermore, the cover portion of the storage container may include a cover front protruding portion disposed to protrude in a length direction of the cover portion from the other side facing the one side of the cover portion so as to be gripped to open the cover portion, wherein the detergent receiving portion includes a cover front protruding portion disposed to protrude in a length direction of the detergent receiving portion from the other side facing the one side of the detergent receiving portion so as to be gripped to open the cover portion, and.

Furthermore, the present disclosure may provide a detergent supply device, including a storage container comprising a detergent receiving portion extending in a length direction to receive detergent or softener and a cover portion configured to close or open the detergent receiving portion; and a frame that receives the storage container to be slid and inserted into or discharged from a clothes treating machine, wherein the cover portion includes a cover rear protruding portion disposed to protrude in a length direction of the cover portion from one side in the length direction of the cover portion so as to be gripped to open the cover, and the detergent receiving portion includes a container rear protruding portion disposed to protrude in a length direction of the detergent receiving portion from one side of the length direction of the detergent receiving portion corresponding to one side of the length direction of the cover portion so as to be gripped to open the cover portion.

Furthermore, a gripping groove portion may be disposed at the one side of the frame of the detergent supply device to expose the cover rear protruding portion and the container rear protruding portion after the storage container is received in the frame.

Furthermore, the gripping groove portion of the detergent supply device may include an opening portion disposed at the upper side, and the cover rear protruding portion and the container rear protruding portion may be inserted into the gripping groove portion through the opening portion when the storage container is received in the frame.

Furthermore, the cover rear protruding portion and the container rear protruding portion may be aligned with each other when the cover portion of the detergent supply device closes the detergent receiving portion.

Furthermore, the frame of the detergent supply device may include a sidewall portion at least partially defining a side surface of the frame and extending in a length direction of the frame, and a sag prevention protruding portion may be disposed on an upper surface of the sidewall portion to prevent the frame from sagging downward after the frame is discharged by a predetermined distance from the clothes treating machine.

Furthermore, the frame of the detergent supply device may include a partition wall portion partitioning a first input opening portion to which detergent or softener is added, and at least one side of the storage container may be located adjacent to the partition wall portion when the storage container is received in the frame, wherein the cover portion includes a detergent guide portion configured to protrude from one side of the storage container adjacent to the partition wall portion to cover an upper surface of the partition wall portion so as to prevent detergent or softener falling from an upper side of the cover portion from flowing into a space between the storage container and the partition wall portion.

Furthermore, the present disclosure may provide a clothes treating machine, including a housing; a tub provided inside the housing; a drum rotatably provided inside the tub; a detergent supply device configured to receive detergent or softener and supply the detergent or softener to the tub; and a detergent supply device coupling portion configured to be slid and insert into or discharged from the detergent supply device, wherein the detergent supply device includes a frame that receives a storage container comprising a detergent receiving portion extending in a length direction to receive detergent or softener and a cover portion configured to close or open the detergent receiving portion, and the cover portion includes a cover rear protruding portion disposed to protrude in a length direction of the cover portion from one side in the length direction of the cover portion so as to be gripped to open the cover portion.

Furthermore, a gripping groove portion may be disposed at the one side of the frame to expose the cover rear protruding portion after the storage container is received in the frame of the clothes treating machine.

Furthermore, the gripping groove portion may include an opening portion disposed at the upper side, and the cover rear protruding portion may be inserted into the gripping groove portion through the opening portion when the storage container is received in the frame.

According to the present disclosure, the following effects may be achieved.

First, detergent or softener to be supplied automatically is received in a storage container. The storage container includes a cover portion not to allow the received detergent or softener to be exposed to the atmosphere.

Accordingly, contamination that may occur as detergent or softener to be supplied automatically is exposed to the atmosphere may be prevented. Furthermore, since the storage container is closed by the cover portion, detergent or softener may not be arbitrarily discharged.

In addition, the storage container in which detergent or softener to be supplied automatically is received is inserted into a detergent supply device. Accordingly, a state of being isolated from detergent or softener directly added to the detergent supply device to be manually supplied may be maintained.

As a result, a user may easily distinguish between detergent or softener to be supplied automatically and detergent or softener to be supplied manually.

Moreover, one side of the storage container is provided with a cover rear protruding portion and a container rear protruding portion. The cover rear protruding portion is disposed to further protrude than the container rear protruding portion.

Accordingly, the user may easily separate the cover portion by gripping the cover rear protruding portion, thereby easily performing the opening and closing of the storage container.

Besides, a gripping groove portion may be disposed at one side of the detergent supply device in which the storage container is received, that is, one side of the detergent supply device corresponding to one side disposed with the cover rear protruding portion and the container rear protruding portion.

Therefore, when the storage container is received in the detergent supply device, the cover rear protruding portion and the container rear protruding portion may pass through an opening portion disposed at an upper side of the gripping groove portion. As a result, when the storage container is received in the detergent supply device, it may not be interrupted by the cover rear protruding portion and the container rear protruding portion.

Besides, the other side facing the one side of the storage container may be provided with a cover front protruding portion and a container front protruding portion. The cover front protruding portion may be disposed to further protrude than the container front protruding portion.

As a result, the user may easily separate the cover portion by gripping the cover front protruding portion. In addition, the cover portion may be separated using one side or the other side of the storage container according to the user's habit or the like, thereby enhancing the convenience of use.

DETAILED DESCRIPTION OF THE EMBODIMENTS

Hereinafter, a detergent supply device 50 according to an embodiment of the present disclosure and a clothes treating machine 1 including the same will be described in detail with reference to the accompanying drawings.

In the following description, in order to clarify the features of the detergent supply device 50 according to an embodiment of the present disclosure and the clothes treatment machine 1 including the same, the description or illustration of some components will be omitted.

1. Definition of Terms

Figure 1:
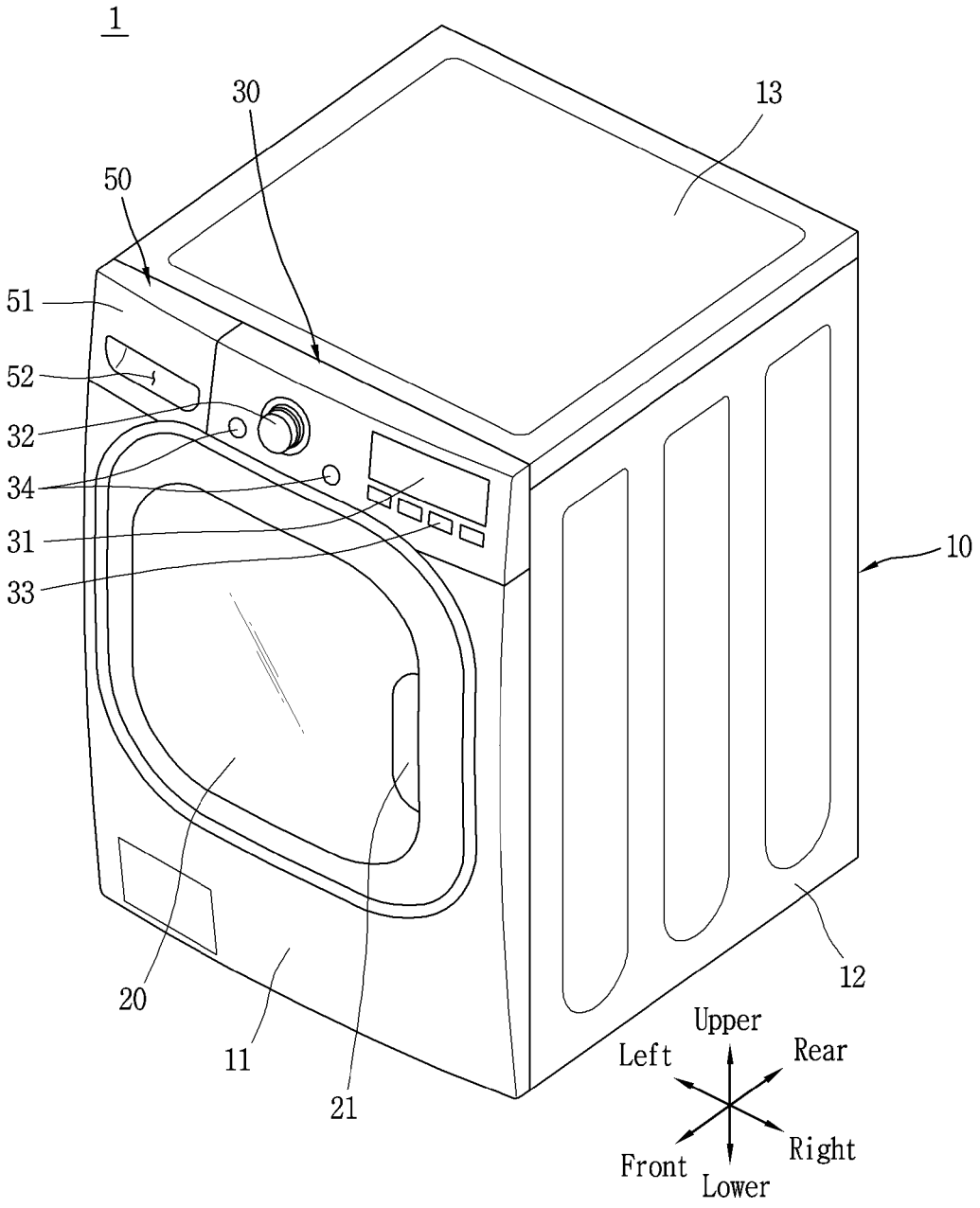
FIG. 1 is a perspective view of a clothes treating machine according to an embodiment of the present disclosure.

The terms "front side", "rear side", "upper side", "lower side", "left side" and "right side" that are used in the following description will be understood with reference to a coordinate system illustrated in FIG. 1.

The term "clothes treating machine" used in the following description denotes any device capable of treating clothes, such as washing or drying clothes. In one embodiment, the clothes treating machine may be a washing machine, a dryer or a dry cleaning device.

The term "detergent" used in the following description denotes any material used to sterilize, disinfect, or remove impurities from clothing or fabrics. In one embodiment, detergent may be a solid or liquid in the form or powder or the like.

The term "softener" used in the following description denotes any substance or chemical used to soften clothes, fabrics or the like.

The term "fluid" used in the following description denotes a fluid that can be mixed with detergent or softener or can act as a solvent of the detergent or softener. In one embodiment, the fluid may be water.

Figure 2:
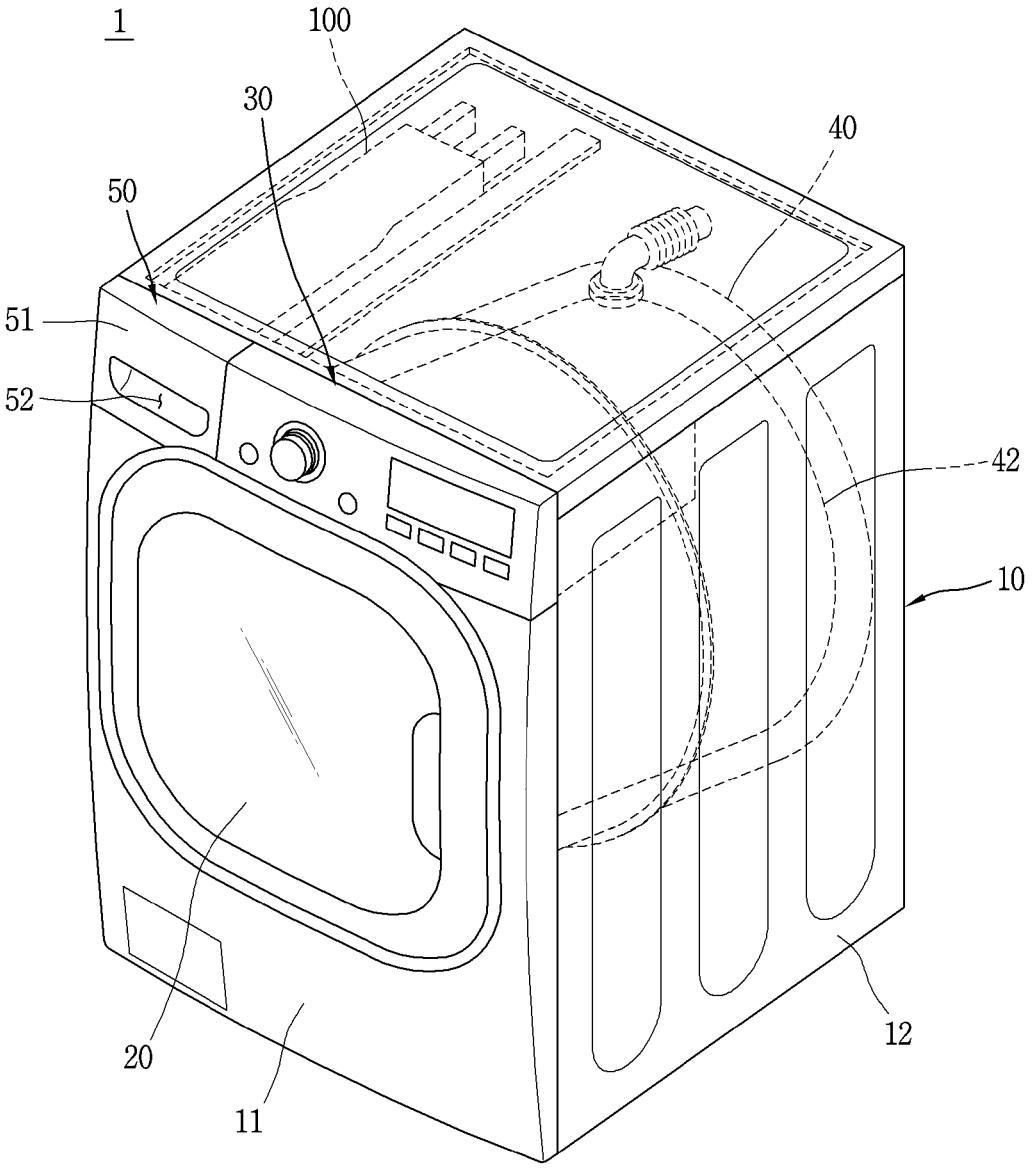
FIG. 2 is a perspective view illustrating an internal configuration of the clothes treating machine in FIG. 1.
Figure 3:
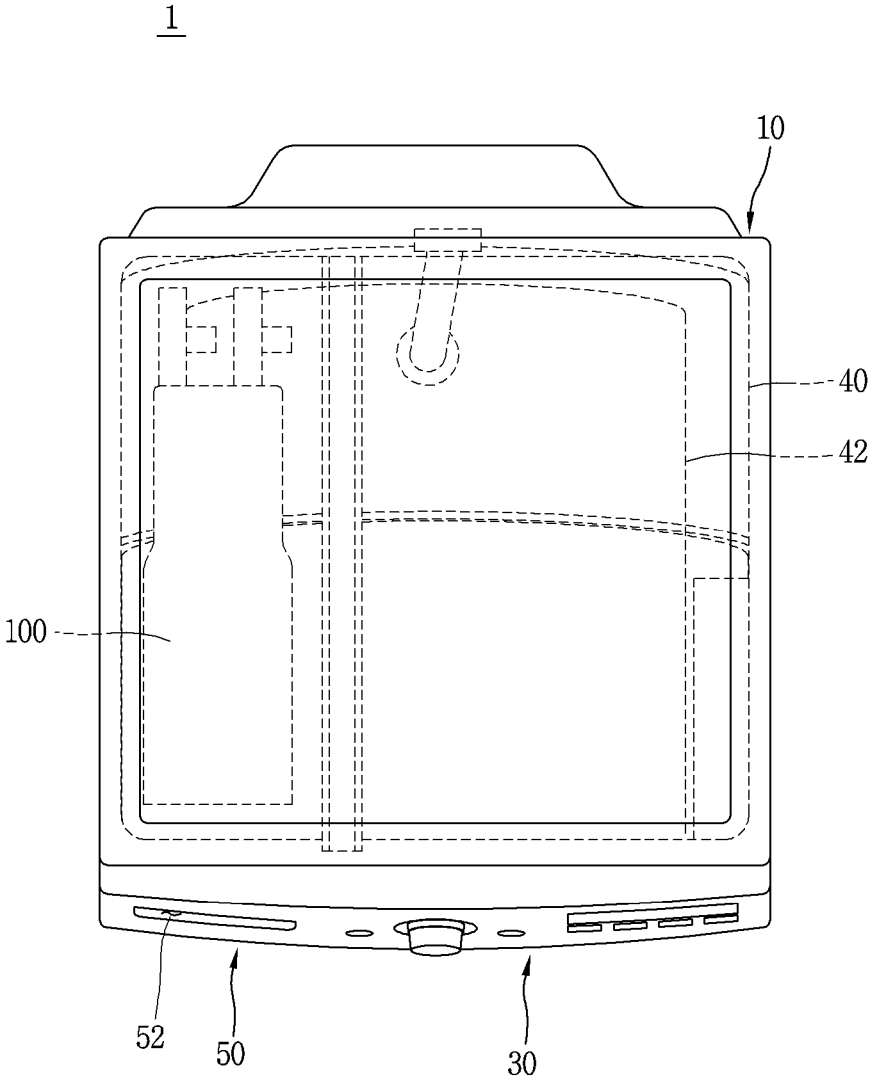
FIG. 3 is a plan view illustrating an internal configuration of the clothes treating machine in FIG. 1.

2. Description of Clothes Treating Machine 1 According to Embodiment of Present Disclosure Referring to FIGS. 1 through 3, the clothes treating machine 1 according to the illustrated embodiment may include a housing 10, a door portion 20, an operation unit 30, a tub 40, and a detergent supply device 50.

Figure 4:
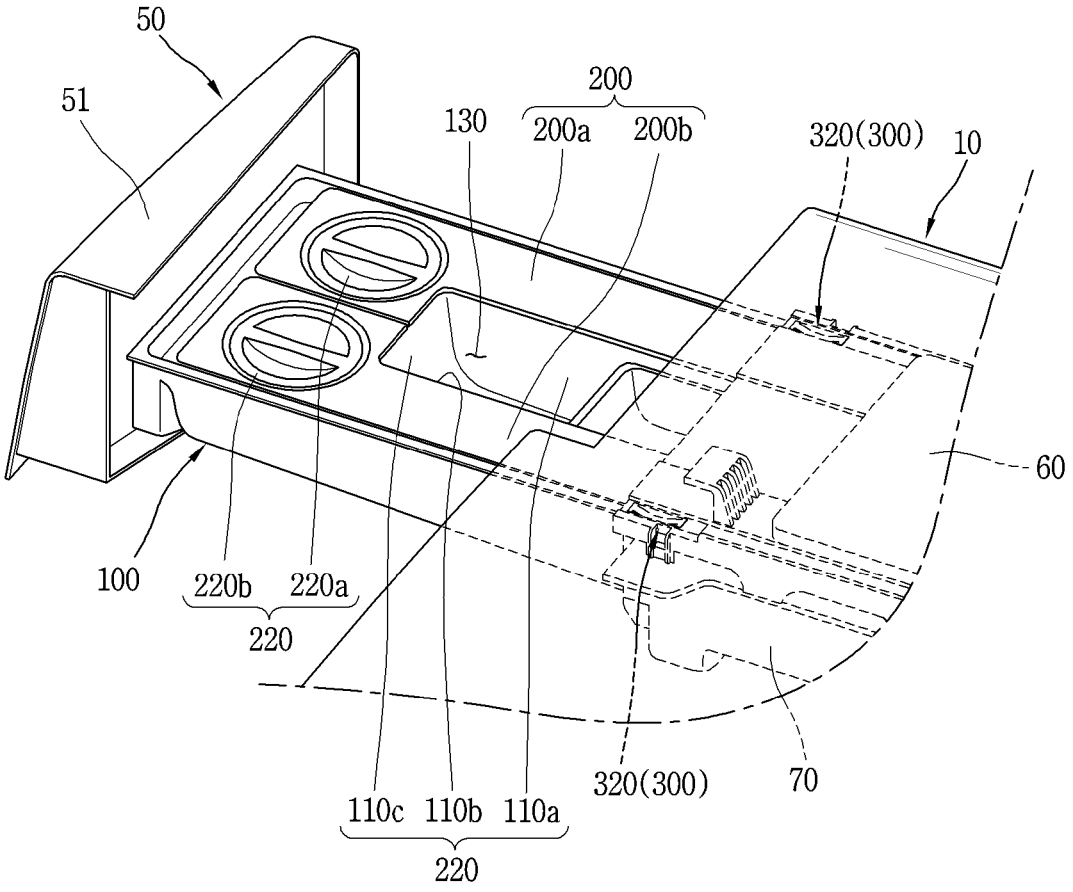
FIG. 4 is a view illustrating a process of allowing a detergent supply device to be coupled to the clothes treating machine in FIG. 1.

In addition, referring further to FIG. 4, the clothes treating machine 1 according to the illustrated embodiment includes a detergent supply device coupling portion 70 into which the detergent supply device 50 is inserted.

Furthermore, the clothes treating machine 1 according to the illustrated embodiment includes a supply passage portion 60 located at an upper side of the detergent supply device 50 inserted into the detergent supply device coupling portion 70.

The housing 10 forms an outer side of the clothes treating machine 1. In an embodiment illustrated herein, the housing 10 has a rectangular parallelepiped shape extending in a vertical direction with a square or rectangular cross section.

The shape of the housing 10 may be changed to any shape capable of receiving the tub 40 which will be described later.

The tub 40 which will be described later is received inside the housing 10. A drum 42 for treating clothes is located inside the tub 40.

In addition, the detergent supply device 50 which will be described later may be inserted into the housing 10 in a detachable manner.

The housing 10 includes a front surface 11, a side surface 12, and an upper surface 13.

The front surface 11 defines a front outer surface of the housing 10. The door portion 20 is coupled to the front surface 11 to allow opening and closing. On the front surface 11, the operation unit 30 and the detergent supply device 50 are located at an upper side of the door portion 20.

The side surface 12 defines left and right outer surfaces of the housing 10. In the illustrated embodiment, the side surface 12 is disposed with a plurality of grooves defined in a rounded manner at the lower side. The shape and number of the grooves is changeable. Alternatively, the grooves may not be disposed on the side surface 12.

In the illustrated embodiment, it will be clearly understood that the side surface 12 is shown with only the right side, but the side surface 12 may also be provided at the left side of the housing 10.

The upper surface 13 defines an upper outer surface of the housing 10. In the illustrated embodiment, the upper surface 13 is square, but its shape is changeable.

The front surface 11, the side surface 12, and the upper surface 13 described above prevent the housing 10 from arbitrarily communicating with the outside. Therefore, it is possible to prevent a material inside the housing 10 from leaking out arbitrarily or an outside material from flowing into the housing 10 arbitrarily.

Although not shown, a lower surface (not shown) defining a lower outer surface of the housing 10 may be provided. In addition, the lower surface (not shown) may be provided with an adjustment member (not shown) for adjusting the center of gravity when the clothes treating machine 1 is placed thereon.

The door portion 20 functions as a path for receiving clothes or fabrics to be treated in the drum 42 which will be described later.

In the illustrated embodiment, the door portion 20 is provided on the front surface 11 to allow opening and closing. The door portion 20 may include a handle 21.

The user may grip the handle 21, and then open the door portion 20 by rotating the door portion 20 with one side (left side in the illustrated embodiment) of the door portion 20 facing the handle 21 as an axis.

In order to perform such an opening operation, a rotation member (not shown) may be provided at one side of the door portion 20. In one embodiment, the rotation member (not shown) may be provided with a hinge (not shown) for rotatably coupling the door portion 20 to the front surface 11.

The operation unit 30 is a portion to which an operation signal for operating the clothes treating machine 1 is input. The user may input various operation signals for treating clothes, such as washing, rinsing, drying, and sterilization, through the operation unit 30.

In the illustrated embodiment, the operation unit 30 is located on the front surface 11, but located at an upper side of the door portion 20. The operation unit 30 may be disposed at any position where the user can easily input the operation signals.

The operation unit 30 includes a display module 31, a dial module 32, an operation button module 33, and an action button module 34.

The display module 31 outputs an operation signal input by the user. In addition, the display module 31 may display an operation being performed by the clothes treating machine 1.

The user may check an operation signal input through the display module 31 and an operation currently performed by the clothes treating machine 1. In addition, the user may check a remaining time for completing an operation being performed through the display module 31.

The dial module 32 and the operation button module 33 are provided to select an operation signal for performing a desired operation by the user. In addition, the action button module 34 receives an action signal for the user to activate the clothes treating machine 1.

The user may select a desired clothes treating operation through the dial module 32 and the operation button module 33 to activate the clothes treating machine 1 using the action button module 34.

The tub 40 is received inside the housing 10. The drum 42 is rotatably provided inside the tub 40.

Detergent or softener may be introduced into the tub 40 from the detergent supply device 50 which will be described later. To this end, the tub 40 may be connected in fluid communication with the detergent supply device 50 through a member (not shown) such as a hose.

The tub 40 may be supplied with a fluid for treating clothes. In one embodiment, the fluid may be water. To this end, the tub 40 may be connected in fluid communication with the supply passage portion 60 or an outside of the clothes treating machine 1 through a member (not shown) such as a hose.

In the illustrated embodiment, the tub 40 may have a cylindrical shape disposed with a hollow portion (not shown) therein, or any shape capable of receiving the drum 42 therein.

The drum 42 is a space in which clothes or fabrics to be treated are received and washed, sterilized, rinsed, or dried by detergent or softener. The drum 42 is received inside the tub 40.

When the door portion 20 is opened, the drum 42 communicates with an outside of the housing 10. The user may open the door portion 20 to receive clothes or fabrics desired to be treated in the drum 42.

When the door portion 20 is closed, the drum 42 is physically blocked from an outside of the housing 10. Therefore, fluid, detergent or softer for treating clothes or fibers received in the drum 42 does not leak out.

In the illustrated embodiment, the drum 42 is provided in a cylindrical shape having a hollow portion therein. In one embodiment, the drum 42 may be provided in any shape capable of receiving clothes or fabrics and treating them.

The drum 42 communicates with the tub 40. Detergent or softener supplied through the detergent supply device 50 may be introduced into the drum 42 through the tub 40. In addition, detergent or softener and a fluid for dissolving the detergent or softener may be introduced into the drum 42 through the tub 40 through the supply passage portion 60.

To this end, a plurality of through holes (not shown) may be disposed on a surface of the drum 42.

The detergent supply device 50 is a portion where detergent or softener is supplied to the clothes treating machine 1. The detergent supply device 50 may be slidably inserted into or slidably discharged from the detergent supply device coupling portion 70 which will be described later.

In one embodiment, the detergent supply device 50 may be configured to automatically supply previously received detergent or softener to the tub 40 according to an operation signal input. In addition, the detergent supply device 50 may be configured to supply detergent or softener manually every time the operation of the clothes treating machine 1 is executed.

Moreover, the detergent supply device 50 may be configured to enable both the above-described automatic supply and manual supply.

The detergent supply device 50 includes a grip portion 51, a frame 100 which will be described later, and a storage container 200.

The grip portion 51 forms the front outer surface of the detergent supply device 50. The user may grip the grip portion 51 to discharge the detergent supply device 50 from the detergent supply device coupling portion 70 which will be described later.

The grip portion 51 is configured to define part of the front surface 11 of the housing 10. In other words, when the detergent supply device 50 is inserted into the detergent supply device coupling portion 70 which will be described later, a front side surface of the grip portion 51 is aligned with the front surface 11 of the housing 10.

The grip portion 51 is defined by recessing a handle groove 52. The user can easily discharge the detergent supply device 50 by gripping the handle groove 52.

The frame 100 which will be described later is disposed to extend at a rear side of the detergent supply device 50. The storage container 200 which will be described later may be detachably received in the frame 100. The detailed description thereof will be described later.

Referring to FIG. 4, the clothes treating machine 1 according to the illustrated embodiment includes a supply passage portion 60 and a detergent supply device coupling portion 70.

The supply passage portion 60 is configured to supply a fluid for treating clothes into the tub 40.

In one embodiment, the supply passage portion 60 may be configured to supply the fluid directly to the tub 40. To this end, the supply passage portion 60 may be connected in fluid communication with the tub 40 through a separate hose (not shown).

In addition, the supply passage portion 60 may be configured to supply a fluid to the detergent supply device 50. To this end, the supply passage portion 60 may be connected in fluid communication with the detergent supply device 50. In addition, the supply passage portion 60 may include a hollow portion (not shown) for defining a passage therein.

In another embodiment, the supply passage portion 60 may be connected in fluid communication with both the tub 40 and the detergent supply device 50. To this end, a hose (not shown) or the like may be provided, or a hollow portion (not shown) for defining a passage may be disposed as described above.

The supply passage portion 60 may be located at an inner upper side of the detergent supply device coupling portion 70 which will be described later. In other words, when the detergent supply device 50 is inserted into the detergent supply device coupling portion 70, the supply passage portion 60 may be located at an upper side of the detergent supply device 50.

By this arrangement method, a fluid supplied through the supply passage portion 60 may efficiently flow into the detergent supply device coupling portion 70 by gravity even when an additional power unit is not provided to flow the fluid into the detergent supply device coupling portion 70.

The supply passage portion 60 includes a sag prevention opening portion 62.

Figure 16:
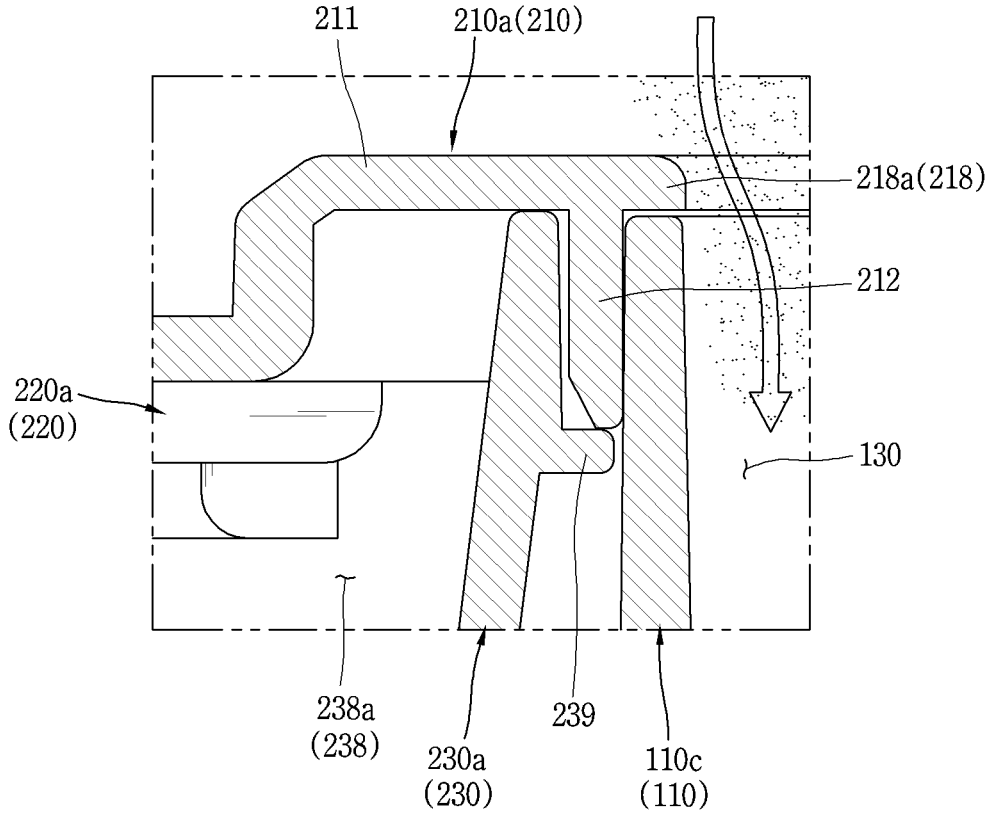
FIG. 16 is a plan view illustrating the position of a sag prevention elastic portion provided in a passage supply portion provided in the clothes treating machine in FIG. 1.
Figure 17:
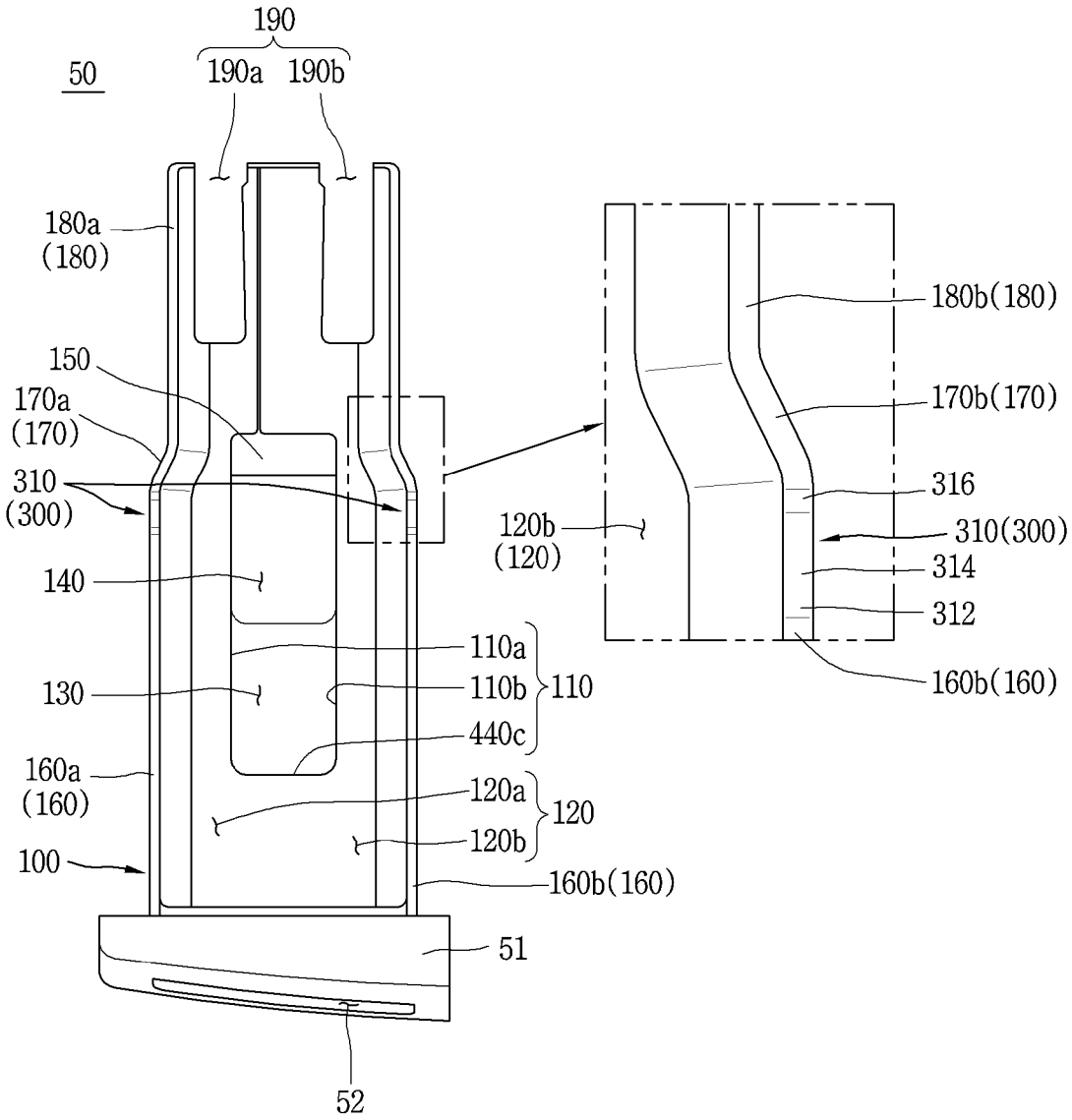
FIG. 17 is a perspective view illustrating the sag prevention elastic portion in FIG. 16.

The sag prevention opening portion 62 is disposed in a front-rear direction, that is, in a length direction of the supply passage portion 60, at a front side of the supply passage portion 60. The sag prevention opening portion 62 may be disposed at the left and right sides of the supply passage portion 60 (see FIGS. 16 through 18).

The sag prevention opening portion 62 is disposed to pass therethrough in a vertical direction of the supply passage portion 60. Accordingly, a curved portion 324 of the sag prevention elastic portion 320 which will be described later may be bent downward through the sag prevention opening portion 62.

As will be described later, the supply passage portion 60 may be provided with a sag prevention elastic portion 320 constituting a sag preventing member 300. The sag prevention elastic portion 320 prevents the detergent supply device coupling portion 70 from sagging downward subsequent to being discharged by a predetermined distance.

The detailed description of the sag preventing member 300 will be described later.

The detergent supply device coupling portion 70 is a portion in which the detergent supply device 50 is inserted into and coupled to the housing 10 of clothes treating machine 1. The detergent supply device coupling portion 70 is disposed with an opening portion for inserting the detergent supply device 50.

In addition, the detergent supply device coupling portion 70 includes a hollow portion (not shown) extending to front and rear sides thereof. When the detergent supply device 50 is inserted, the grip portion 51 is exposed to a front side of the housing 10, but the frame 100 which will be described later may be received in the hollow portion (not shown).

The supply passage portion 60 is located at an inner upper side of the detergent supply device coupling portion 70. A fluid for treating clothes may be supplied from the supply passage portion 60 to the detergent supply device 50.

A guide rail (not shown) extending in a length direction, that is, a front-back direction in the illustrated embodiment, may be disposed to protrude from either one side surface of the detergent supply device 50 and the detergent supply device coupling portion 70.

Furthermore, a guide groove portion (not shown) extending in a length direction, that is, a front-back direction in the illustrated embodiment, may be disposed to be recessed from the other side surface of the detergent supply device 50 and the detergent supply device coupling portion 70.

The detergent supply device 50 may be efficiently inserted into the detergent supply device coupling portion 70 by the guide rail (not shown) and the guide groove (not shown), 3. Description of Detergent Supply Device 50 According to Embodiment of Present Disclosure Referring to FIGS. 4 through 7, the detergent supply device 50 according to an embodiment of the present disclosure includes a frame 100, a storage container 200, a sag preventing member 300, and a storage container opening member 400.

The frame 100 extends in a length direction, that is, a rear side in the illustrated embodiment, from the grip portion 51 defining a front side of the detergent supply device 50. In addition, the storage container 200 may be detachably received in a space disposed in the frame 100.

The storage container 200 is provided with a detergent guide portion 218 to prevent released detergent powder or the like from remaining in the detergent supply device 50.

The sag preventing member 300 prevents the detergent supply device 50 from inclining downward when the detergent supply device 50 is discharged from the detergent supply device coupling portion 70 by a predetermined distance.

In addition, the storage container 200 is provided with a storage container opening member 400 to allow the user to easily open and close the storage container 200.

Hereinafter, the detergent supply device 50 according to an embodiment illustrated with reference to FIGS. 4 through 7 will be described in detail, but the detergent guide portion 218, the sag preventing member 300, and the storage container opening member 400 will be described in another section.

(1) Description of Frame 100

The frame 100 defines a rear side of the detergent supply device 50. In the illustrated embodiment, the frame 100 is disposed to extend to a rear side of the grip portion 51.

As described above, the detergent supply device 50 may be slidably inserted into or discharged from the detergent supply device coupling portion 70. When the detergent supply device 50 is fully inserted into the detergent supply device coupling portion 70, the frame 100 is received in a hollow portion (not shown) of the detergent supply device coupling portion 70.

In other words, when the detergent supply device 50 is fully inserted into the detergent supply device coupling portion 70, the frame 100 is not exposed to an outside of the housing 10.

In the illustrated embodiment, an upper side of the frame 100 is open. In other words, an opening portion is disposed at an upper side of the frame 100.

Through the opening portion, the storage container 200 which will be described later may be detachably received. Furthermore, the user may manually supply detergent or softener to a first input opening portion 130 and a second input opening portion 140, which will be described later, through the opening portion.

The frame 100 includes a partition wall portion 110, a container receiving portion 120, a first input opening portion 130, a second input opening portion 140, a release preventing portion 150, a sidewall portion 160, and an inclined portion 170, an insertion portion 180, and the gripping groove portion 190.

The partition wall portion 110 partitions an internal space of the frame 100. Specifically, the partition wall portion 10 partitions the container receiving portion 120, the first input opening portion 130, and the second input opening portion 140, which will be described later.

In the illustrated embodiment, the partition wall portion 110 is provided in the form of a wall body protruding upward from a lower surface of the frame 100. The partition wall portion 110 may be provided in any form capable of partitioning a space.

The partition wall portion 110 includes a first partition wall portion 110*a*, a second partition wall portion 110*b*, and a third partition wall portion 110*c*.

The first partition wall portion 110*a* is located adjacent to the storage container 200 to partition the first container receiving portion 120*a* and the first inlet opening portion 130 of the container receiving portion 120, which will be described later. In addition, the first partition wall portion 110*a* partitions the first container receiving portion 120*a* and the second input opening portion 140.

In the illustrated embodiment, the first partition wall portion 110*a* is disposed to extend in a length direction, that is, a front-rear direction of the frame 100. In addition, the first partition wall portion 110*a* is spaced apart from the second partition wall portion 110*b* by a predetermined distance to extend in the same direction. In one embodiment, the first partition wall portion 110*a* and the second partition wall portion 110*b* may be disposed in parallel.

The second partition wall portion 110*b* partitions the second container receiving portion 120*b* of the container receiving portion 120 which will be described later and the first input opening portion 130. Furthermore, the second partition wall portion 110*b* partitions the second container receiving portion 120*b* and the second input opening portion 140.

In the illustrated embodiment, the second partition wall portion 110*b* is disposed to extend in a length direction, that is, a front-rear direction of the frame 100. In addition, the second partition wall portion 110*b* is spaced apart from the first partition wall portion 110*a* by a predetermined distance to extend in the same direction. In one embodiment, the second partition wall portion 110*b* and the first partition wall portion 110*a* may be disposed in parallel.

The third partition wall portion 110*c* extends from a front end portion of the first partition wall portion 110*a* toward the second partition wall portion 110*b* at a predetermined angle with the first partition wall portion 110*a*. Alternatively, the third partition wall portion 110*c* extends from a front end portion of the second partition wall portion 110*b* toward the first partition wall portion 110*b* at a predetermined angle with the second partition wall portion 110*b*.

In the illustrated embodiment, the first partition portion 110*a* and the third partition wall portion 110*c* are in contact with each other at a right angle or an acute angle, and the second partition wall portion 110*b* and the third partition wall portion 110*c* are also in contact with each other at a right angle or an acute angle.

An angle between the first partition wall portion 110*a* and the third partition wall portion 110*c* and an angle between the second partition wall portion 110*b* and the third partition wall portion 110*c* may be changed. However, the angles are preferably determined to correspond to the shape of the storage container 200 which will be described later.

An inner space of the frame 100 is partitioned into the first container receiving portion 120*a*, the first inlet opening portion 130, the second inlet opening portion 140, and the second container receiving portion 120*b* by the partition wall portion 110.

In other words, the first input opening portion 130 and the second input opening portion 140 are located between the first container receiving portion 120*a* and the second container receiving portion 120*b*.

Based on the frame 100, the first container receiving portion 120*a* is located at the front and right sides of the frame 100.

Furthermore, the second container receiving portion 120*b* is located on the front and right sides of the frame 100.

The first input opening portion 130 and the second input opening portion 140 are located between the first container receiving portion 120*a* and the second container receiving portion 120*b*. In other words, the first inlet opening portion 130 and the second inlet opening 140 are wrapped around the first container receiving portion 120*a* and the second container receiving portion 120*b*.

As will be described later, the first storage container 200*a* and the second storage container 200*b* of the storage container 200 are received in the first container receiving portion 120*a* and the second container receiving portion 120*b*, respectively.

At this time, detergent powder or the like may be introduced into a space between the first storage container 200*a* and the partition wall portion 110 and a space between the second storage container 200*b* and the partition wall portion 110.

The storage container 200 according to an embodiment of the present disclosure includes a detergent guide portion 218 for preventing the detergent powder from being introduced into the space. The detailed description thereof will be described later.

The container receiving portion 120 is a space in which the storage container 200 which will be described later is received in the frame 100.

In the illustrated embodiment, the storage container 200 which will be described later is provided with a plurality of first storage containers 200*a* and second storage containers 200*b*. Accordingly, the container receiving portion 120 includes a first container receiving portion 120*a* and a second container receiving portion 120*b*.

The number and shape of the container receiving portion 120 may be changed to correspond to the number and shape of the storage container 200 which will be described later.

The first container receiving portion 120*a* and the second container receiving portion 120*b* are partitioned by the partition wall portion 110.

Specifically, the first container receiving portion 120*a*, the first inlet opening portion 130, and the second inlet opening portion 140 are partitioned by the first partition wall portion 110*a* and the third partition wall portion 110*c*.

In addition, the second container receiving portion 120*b*, the first input opening portion 130, and the second input opening portion 140 are partitioned by the second partition wall portion 110*b* and the third partition wall portion 110*c*.

In the illustrated embodiment, the front sides of the first container receiving portion 120*a* and the second container receiving portion 120*b* communicate with each other. Alternatively, a separate partition member (not shown) may be provided to physically partition the first container receiving portion 120*a* and the second container receiving portion 120*b*.

The first input opening portion 130 is a space in which a user can manually input detergent or softener. Detergent put into the first input opening portion 130 may be mixed with a fluid supplied from the supply passage portion 60 to flow into the tub 40.

To this end, the first input opening portion 130 may be configured to communicate with the tub 40 by a member (not shown) for defining a passage.

The first input opening portion 130 is partitioned by the partition wall portion 110.

Specifically, a front side of the first input opening portion 130 is partitioned by the second partition wall portion 110*b*. Furthermore, the left and right sides of the first input opening portion 130 are partitioned off by the first partition wall portion 110*a* and the second partition wall portion 110*b*, respectively.

The first input opening portion 130 is located at a front side of the second input opening portion 140 and the release preventing portion 150. The positions of the first input opening portion 130 and the second input opening portion 140 may be changed.

However, the release preventing portion 150 defines the maximum distance that can be discharged while the detergent supply device 50 is inserted into the clothes treating machine 1, and thus preferably located at a rear side of the first input opening portion 130 and the second input opening portion 140.

The first input opening portion 130 includes an input speed adjusting plate 132.

The input speed adjusting plate 132 adjusts an amount of detergent or softener put into the first input opening portion 130 and introduced into the tub 40. The left and right end portions of the input speed adjusting plate 132 are coupled to the first partition wall portion 110*a* and the second partition wall portion 110*b*.

The input speed adjusting plate 132 is spaced apart by a predetermined distance from a lower surface of the first input opening portion 130. In other words, an opening portion through which detergent or softener may pass is disposed between a lower side of the input speed adjusting plate 132 and a lower surface of the first input opening portion 130.

When a fluid flows into the first input opening portion 130, the fluid is mixed with detergent or softener supplied to the first input opening portion 130. The detergent or softener mixed with the fluid may flow into the tub 40 through an opening portion disposed between the input speed adjusting plate 132 and a lower surface of the first input opening portion 130.

The input speed adjusting plate 132 may be coupled to the first partition wall portion 110*a* and the second partition wall portion 110*b* so as to be movable in a vertical direction. Through this, an amount of mixture of the detergent or softener and the fluid flowing into the tub 40 according to the use state may be changed.

The first input opening portion 140 is a space in which a user can manually input softener or detergent. Softener or detergent put into the second input opening portion 140 may flow into the tub 40. To this end, the second input opening portion 140 may be configured to communicate with the tub 40 by a member (not shown) for defining a passage.

Alternatively, softener or detergent put into the second input opening portion 140 may be mixed with a fluid supplied from the supply passage portion 60 to flow into the tub 40.

The second input opening portion 140 is partitioned by the partition wall portion 110.

Specifically, a left side of the second input opening portion 140 is partitioned by the first partition wall portion 110*a*. In addition, a right side of the second input opening portion 140 is partitioned by the second partition wall portion 110*b*.

Furthermore, the second input opening portion 140 is partitioned from the first input opening portion 130 by a separate partition member.

The first input opening portion 130 is located at a front side of the second input opening portion 140. Furthermore, the release preventing portion 150 is located at a rear side of the second input opening portion 140.

The positions of the second input opening portion 140 and the first input opening portion 130 may be changed. However, as described above, the release preventing portion 150 may be preferably located at a rear side of the first input opening portion 130 and the second input opening portion 140.

The release preventing portion 150 defines a predetermined distance at which the detergent supply device 50 can be slidably moved from the detergent supply device coupling portion 70 without being separated from the clothes treating machine 1.

In other words, the detergent supply device 50 may be slidably moved and discharged from the detergent supply device coupling portion 70.

At this time, when the detergent supply device 50 is discharged by a predetermined distance from the detergent supply device coupling portion 70, further movement in a direction of being discharged by the release preventing portion 150 is limited.

As will be described later, the frame 100 and the detergent supply device coupling portion 70 according to an embodiment of the present disclosure may be provided with a sag preventing member 300.

The release preventing portion 150 may be caught by the supply passage portion 60 located at an inner upper side of the detergent supply device coupling portion 70 or a release preventing member (not shown) disposed on an inner upper surface of the detergent supply device coupling portion 70, thereby defining a predetermined distance.

When the detergent supply device 50 is discharged by a predetermined distance defined by the release preventing portion 150, the detergent supply device 50 may be prevented from being inclined downward by the sag preventing member 300. The detailed description thereof will be described later.

The release preventing portion 150 may be disposed to have elasticity. In other words, when the release preventing portion 150 is pressed downward, the release preventing portion 150 may be moved downward. In addition, when a force that has pressed the release preventing portion 150 is removed, the release preventing portion 150 may be returned to its original state.

Therefore, when the detergent supply device 50 needs to be separated from the clothes treating machine 1, the user may press the release preventing portion 150, thereby separating the detergent supply device 50 without limiting a discharge distance by the release preventing portion 150.

For the above process, the release preventing portion 150 may include a pressing member (not shown) for allowing the user to press and an elastic member (not shown) for providing an elastic force to the pressing member (not shown).

In the illustrated embodiment, the release preventing portion 150 is located at a rear side of the first input opening portion 130 and the second input opening portion 140. As described above, the release preventing portion 150 defines the maximum distance that can be discharged while the detergent supply device 50 is not separated.

Therefore, the release preventing portion 150 is preferably located at a rear side of the first input opening portion 130 and the second input opening portion 140 so as to allow the user to easily supply detergent or softener, without separating the detergent supply device 50.

In the illustrated embodiment, the release preventing portion 150 is located between the first container receiving portion 120*a* and the second container receiving portion 120*b*. Furthermore, the first partition wall portion 110*a* is located at a left side of the release preventing portion 150, and the second partition wall portion 110*b* is located at a right side of the release preventing portion 150.

Moreover, the first storage container 200*a* and the second storage container 200*b* which will be described later are located at a rear side of the release preventing portion 150.

In other words, the left, right and rear sides of the release preventing portion 150 are disposed to be surrounded by the first storage container 200*a* and the second storage container 200*b* which will be described later.

The left and right outer surfaces of the frame 100 are defined by the sidewall portion 160, the inclined portion 170, and the insertion portion 180.

The sidewall portion 160 defines at least part of the left and right outer surfaces of the frame 100. In the illustrated embodiment, the sidewall portion 160 includes a first sidewall portion 160*a* on the left side and a second sidewall portion 160*b* on the right side.

The first sidewall portion 160*a* together with the first partition wall portion 110*a* defines at least part of the first container receiving portion 120*a*. In other words, a space between the first sidewall portion 160*a* and the first partition wall portion 110*a* is part of the first container receiving portion 120*a*.

The second sidewall portion 160*b* together with the second partition wall portion 110*b* defines at least part of the second container receiving portion 120*b*. In other words, a space between the second sidewall portion 160*b* and the second partition wall portion 110*b* is part of the second container receiving portion 120*b*.

The first sidewall portion 160*a* and the second sidewall portion 160*b* are located to be spaced apart by a predetermined distance. In one embodiment, the first sidewall portion 160*a* and the second sidewall portion 160*b* may be disposed in parallel to each other.

In the illustrated embodiment, the first sidewall portion 160*a* and the second sidewall portion 160*b* is separated by a distance greater than that between the first inclined portion 170*a* and the second inclined portion 170*b* and that between the first insertion portion 180*a* and the second insertion portion 180*b*.

This is to allow the detergent supply device 50 to be easily inserted into the detergent supply device coupling portion 70.

In detail, the first insertion portion 180*a* and the second insertion portion 180*b* of the detergent supply device 50 are first inserted into the detergent supply device coupling portion 70.

A width of the frame 100 may be configured to gradually increase as the detergent supply device 50 is inserted, thereby allowing the user to easily insert the detergent supply device 50 into the detergent supply device coupling portion 70.

A sag prevention protruding portion 310 which will be described later is disposed on an upper surface of an end portion of the sidewall portion 160 adjacent to the inclined portion 170. The detailed description thereof will be described later.

The inclined portion 170 defines at least part of the left and right outer surfaces of the frame 100. The inclined portion 170 defines a predetermined angle with the sidewall portion 160 from a rear end portion of the sidewall portion 160 to extend to the rear side.

In one embodiment, the inclined portion 170 may extend to the rear side while defining an obtuse angle with the sidewall portion 160.

The inclined portion 170 includes a first inclined portion 170*a* on the left side and a second inclined portion 170*b* on the right side.

The first inclined portion 170*a* defines part of the first container receiving portion 120*a* together with the first partition wall portion 110*a*. In other words, a space between the first inclined portion 170*a* and the first partition wall portion 110*a* is part of the first container receiving portion 120*a*.

The second inclined portion 170*b* defines part of the second container receiving portion 120*b* together with the second partition wall portion 110*b*. In other words, a space between the second inclined portion 170*b* and the second partition wall portion 110*b* is part of the second container receiving portion 120*b*.

The first inclined portion 170*a* and the second inclined portion 170*b* may extend in directions facing each other.

In other words, a distance between an end portion facing the first sidewall portion 160*a* of the first inclined portion 170*a* and an end portion facing the second sidewall portion 160*b* of the second inclined portion 170*b* extends to be larger than that between an end portion opposite to the first inclined portion 170*a* and an end portion opposite to the second inclined portion 170*b*.

In other words, the widths of the first inclined portion 170*a* and the second inclined portion 170*b* are disposed to be smaller as they go toward a rear direction of the frame 100.

The insertion portion 180 defines the remaining part of an outer surface of the left and right sides of the frame 100. The insertion portion 180 extends to a rear side while defining a predetermined angle with the inclined portion 170 from a rear end portion of the inclined portion 170.

In one embodiment, the insertion portion 180 may extend to a rear side while defining an obtuse angle with the inclined portion 170.

The insertion portion 180 includes a first insertion portion 180*a* at the left side and a second insertion portion 180*b* at the right side.

The remaining part of the first container receiving portion 120*a* and the second container receiving portion 120*b* is disposed between the first insertion portion 180*a* and the second insertion portion 180*b*. In other words, a space between the first insertion portion 180*a* and the second insertion portion 180*b* is the remaining part of a rear side of the first container receiving portion 120*a* and the second container receiving portion 120*b*.

The first insertion portion 180*a* and the second insertion portion 180*b* are located to be spaced apart by a predetermined distance. As described above, a distance between the first insertion portion 180*a* and the second insertion portion 180*b* is disposed to be smaller than that between the first sidewall portion 160*a* and the second sidewall portion 160*b*.

In one embodiment, the first insertion portion 180*a* and the second insertion portion 180*b* may be disposed in parallel to each other.

The gripping groove portion 190 is disposed on a rear side surface of the frame 100. The gripping groove portion 190 is a space in which the user can grip the storage container 200, which will be described later, received in the container receiving portion 120.

Figure 14:
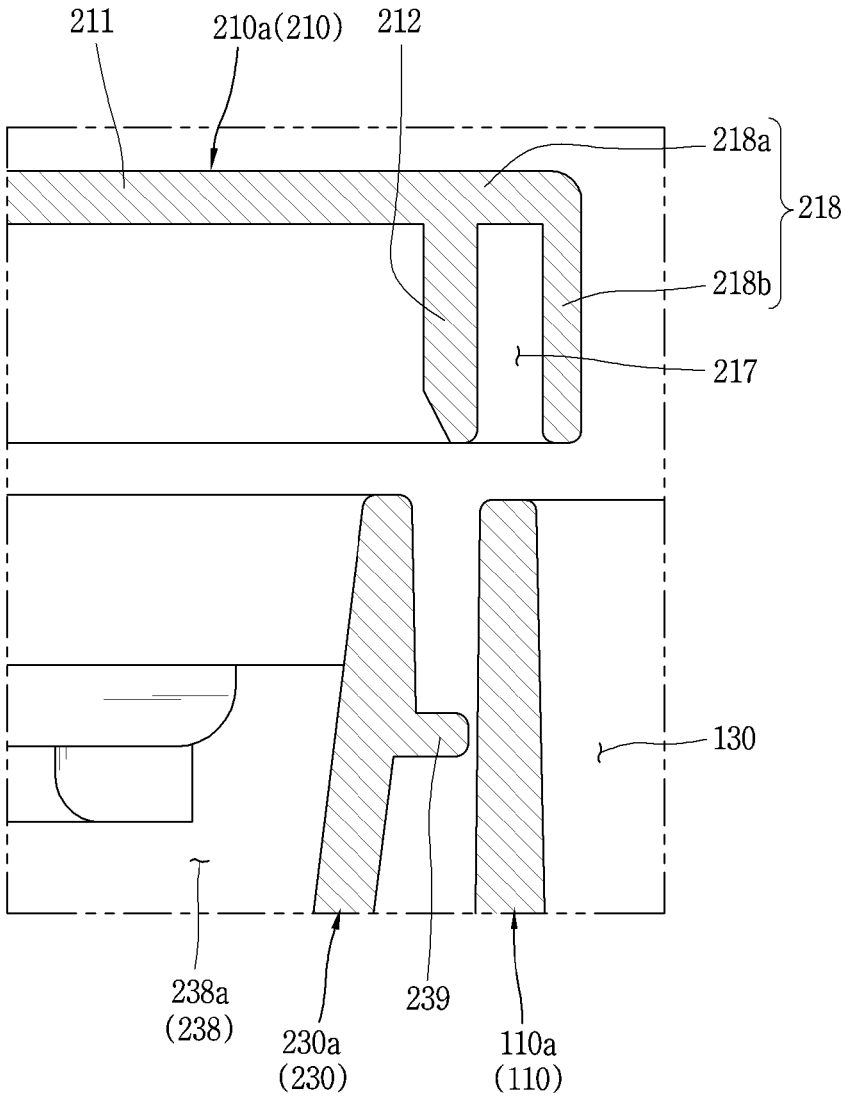
FIG. 14 is a plan view illustrating a frame from which the storage container is removed in the detergent supply device in FIG. 4.
Figure 15:
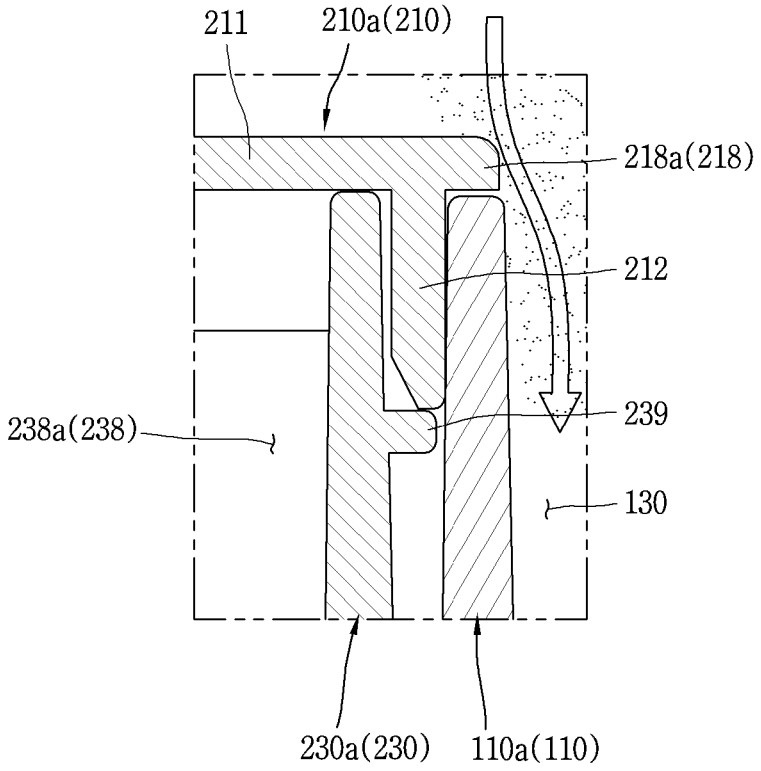
FIG. 15 is a perspective view illustrating a sag prevention protruding portion provided in the frame in FIG. 14.

In the illustrated embodiment, the gripping groove portion 190 is disposed to pass through a rear side surface of the frame 100, but the upper side is defined as an opening portion having an open upper side (see FIG. 14).

Through the opening portion, the storage container opening member 400 provided at a rear side of the storage container 200 which will be described later may pass through the gripping groove portion 190. Therefore, the storage container 200 may be efficiently received in the frame 100 without causing the storage container opening member 400 to be caught by the frame 100.

Furthermore, the gripping groove portion 190 provides a path through which a detergent outlet port 236 of the storage container 200 which will be described later can communicate with the tub 40.

(2) Description of Storage Container 200

Hereinafter, the storage container 200 according to an embodiment of the present disclosure will be described in detail with reference to FIGS. 4 through 8.

The storage container 200 according to an embodiment of the present disclosure includes a detergent guide portion 218 for preventing the residual of detergent, a sag preventing member 300 for preventing the storage container from sagging downward after being discharged by a predetermined distance, and storage container opening member 400 for easily opening the storage container 200.

The detergent guide portion 218, the sag preventing member 300 and the storage container opening member 400 will be described in another section.

Detergent or softener is received in the storage container 200. The storage container 200 is configured to automatically supply detergent or softener received therein to the tub 40.

The storage container 200 is received in the container receiving portion 120 of the frame 100. When the storage container 200 is received, at least one side of the storage container 200 is located adjacent to the partition wall portion 110.

The storage container 200 may be formed of a flexible material to allow the deformation of the shape to some extent.

In the illustrated embodiment, the storage container 200 includes a first storage container 200*a* and a second storage container 200*b*.

In one embodiment, detergent may be contained in either one of the first storage container 200*a* and the second storage container 200*b*. In addition, softener may be received in the other one of the first storage container 200*a* and the second storage container 200*b*.

The number of storage containers 200 and the material received in the storage container 200 may be changed. For an example, four storage containers 200 may be provided in total, and detergent may be received in three storage containers 200, and softener may be received in the remaining one storage container 200.

In the illustrated embodiment, the storage container 200 has a polygonal shape with the largest width at the front side, and a width decreasing toward the rear side, and increasing again but smaller than that of the front side.

The shape of the storage container 200 may be changed. In this case, the shape of the container receiving portion 120 in which the storage container 200 is received may also be preferably changed to correspond to that of the storage container 200.

When the storage container 200 is received in the container receiving portion 120, the first storage container 200*a* is located adjacent to at least part of the third partition wall portion 110*c* and the first partition wall portion 110*a*.

In addition, the second storage container 200*b* is located adjacent to at least part of the remainder of the third partition wall portion 110*c* and the second partition wall portion 110*b*.

The storage container 200 includes a cover portion 210, a stopper portion 220, and a detergent receiving portion 230.

The cover portion 210 defines an upper outer surface of the storage container 200. The cover portion 210 is configured to open or close the detergent receiving portion 230 which will be described later. In other words, the cover portion 210 serves as a lid of the detergent receiving portion 230.

The shape of the cover portion 210 is preferably determined to correspond to that of the detergent receiving portion 230 which will be described later.

In the illustrated embodiment, the storage container 200 includes a first storage container 200*a* and a second storage container 200*b*.

Accordingly, the cover portion 210 includes a first cover portion 210*a* provided in the first storage container 200*a* and a second cover portion 210*b* provided in the second storage container 200*b*.

The cover portion 210 includes a flat portion 211 and a vertical surface portion 212.

Furthermore, the cover portion 210 may include a detergent guide portion 218, and may be provided with a partition wall portion insertion opening portion 217 into which the partition wall portion 110 is inserted by the detergent guide portion 218. This will be described in another section.

The flat portion 211 constitutes an upper surface of the cover portion 210. When the cover portion 210 is coupled to the detergent receiving portion 230 which will be described later, the flat portion 211 completely closes an opening portion disposed at an upper side of the detergent receiving portion 230.

To this end, the shape of the flat portion 211 is preferably determined according to the shape of a side surface of the detergent receiving portion 230 defining an upper opening of the detergent receiving portion 230.

The vertical surface portion 212 is a portion in which the cover portion 210 is coupled to the detergent receiving portion 230 which will be described later.

The vertical surface portion 212 extends downward at a predetermined angle from the side surface of the flat portion 211. In the illustrated embodiment, the vertical surface portion 212 extends downward perpendicular to the flat portion 211.

In addition, the extension length of the vertical surface portion 212 may be determined to correspond to the position of the coupling protruding portion 239 protruding horizontally from the detergent receiving portion 230 which will be described later.

When the cover portion 210 is coupled to the detergent receiving portion 230 which will be described later, an inner side surface of the vertical surface portion 212 is located adjacent to an outer surface of the detergent receiving portion 230 which will be described later. In other words, the cover portion 210 and the detergent receiving portion 230 are coupled to each other while the vertical surface portion 212 surrounds an outer surface of the detergent receiving portion 230.

At this time, a lower end portion of the vertical surface portion 212 is brought into contact with an upper surface of the coupling protruding portion 239. Accordingly, the cover portion 210 and the detergent receiving portion 230 may be stably coupled to each other.

The stopper portion 220 is configured to open or close an opening portion (not shown) of the cover portion 210.

Specifically, the user may open an opening portion (not shown) of the cover portion 210 using the stopper portion 220 while the storage container 200 is received in the frame 100, thereby supplying detergent or softener to the storage container 200.

In the illustrated embodiment, the stopper portion 220 includes a first stopper portion 220*a* and a second stopper portion 220*b*. The first stopper portion 220*a* is provided at the first cover portion 210*a*, and the second stopper portion 220*b* is provided at the second cover portion 210*b*.

The number of stopper portions 220 may be changed to correspond to that of storage containers 200.

The stopper portion 220 may be located at one side of the cover portion 210. In the illustrated embodiment, the stopper portion 220 is located at a front side of the cover portion 210.

Accordingly, even when the detergent supply device 50 is slid and discharged only a short distance from the detergent supply device coupling portion 70 while the storage container 200 is coupled to the detergent supply device 50, the user may supply detergent or softener to the storage container 200.

The detergent receiving portion 230 receives detergent or softener.

An opening portion is disposed at an upper side of the detergent receiving portion 230, and the user may supply detergent or softener through the opening. The detergent or softener received in the detergent receiving portion 230 may be automatically supplied to the tub 40 according to an operation signal applied through the operation unit 30 by the user.

To this end, the detergent receiving portion 230 may be connected in fluid communication with the tub 40 through a hose (not shown).

An outer surface of the detergent receiving portion 230 may be wrapped by the vertical surface portion 212 of the cover portion 210. In other words, when the cover portion 210 is coupled to the detergent receiving portion 230, the vertical surface portion 212 of the cover portion 210 is located adjacent to an outer side of an outer surface of the detergent receiving portion 230.

In the illustrated embodiment, the storage container 200 includes a first storage container 200*a* and a second storage container 200*b*.

Accordingly, the detergent receiving portion 230 includes a first detergent receiving portion 230*a* provided in the first storage container 200*a* and a second detergent receiving portion 230*b* provided in the second storage container 200*b*.

The detergent receiving portion 230 includes a first side surface 231, a second side surface 232, a third side surface 233, a fourth side surface 234, a fifth side surface 235, a detergent outlet port 236, and a detergent space portion 238 and a coupling protruding portion 239.

The first side surface 231 to the fifth side surface 235 define a surface of a surface where the detergent receiving portion 230 faces. In other words, the first side surface 231 to the fifth side surface 235 are side surfaces in directions in which detergent receiving portions 230*a* and 230*b* face each other.

The first side surface 231 is configured to face the third partition wall portion 110*c* of the partition wall portion 110. In other words, the first side surface 231 extends in the left and right directions.

The second side surface 232 extends rearward from an end portion of the first side surface 231 at a predetermined angle with the first side surface 231. In one embodiment, an angle between the second side surface 232 and the first side surface 231 may be a right angle or an obtuse angle. The second side surface 232 faces the first partition wall portion 110*b* of the partition wall portion 110.

The third side surface 233 extends from an end portion of the second side surface 232 in left and right directions at a predetermined angle with the second side surface 232. In one embodiment, an angle between the third side 233 and the second side 232 may be a right angle or an obtuse angle. In addition, the third side surface 233 may be disposed in parallel to the first side surface 231.

The fourth side surface 234 extends rearward from an end portion of the third side surface 233 at a predetermined angle with the third side surface 233. In one embodiment, an angle between the fourth side 234 and the third side 233 may be a right angle or an obtuse angle. Furthermore, the fourth side surface 234 may be disposed in parallel to the second side surface 232.

The fifth side surface 235 extends forward from an end portion of the first side surface 231 at a predetermined angle with the first side surface 231. In one embodiment, an angle between the fifth side surface 235 and the first side surface 231 may be a right angle or an obtuse angle. In addition, the fifth side surface 235 may be disposed in parallel to the second side surface 232 and the fourth side surface 234.

Although not designated by reference numerals, the second detergent receiving portion 230*b* also includes the first side surface 231 through the fifth side surface 235.

The second side surfaces 232, the fourth side surfaces 234, and the fifth side surfaces 235 of the first detergent receiving portion 230*a* and the second detergent receiving portion 230*b* face each other. In particular, the second side surfaces 232 of the first detergent receiving portion 230*a* and the second detergent receiving portion 230*b* are configured to face each other with the first input opening portion 130 therebetween.

The detergent outlet port 236 is a path through which detergent or softener received in the detergent receiving portion 230 flows into the tub 40. The detergent outlet port 236 communicates the detergent receiving portion 230 with the tub 40.

In the illustrated embodiment, the detergent outlet port 236 is located at a lower rear side of the detergent receiving portion 230.

In order to efficiently discharge detergent or softener received in the detergent receiving portion 230, a lower inner surface of the detergent receiving portion 230 is preferably disposed to be inclined toward the rear side.

The detergent receiving portion 230 may be provided with a separate packing member (not shown). The packing member (not shown) is preferably configured to close the detergent receiving portion 230 when it is not required to discharge detergent or softener.

The clothing treating machine 1 according to an embodiment of the present disclosure may include a first storage container 200*a* and a second storage container 200*b*, and thus the detergent receiving portion 230 may also be provided in the first detergent receiving portion 230*a* and the second detergent receiver portion 230*b*, respectively.

The detergent space portion 238 is a space disposed inside the detergent receiving portion 230. Detergent or softener is received in the detergent space portion 238.

The detergent space portion 238 may be disposed in the first detergent receiving portion 230*a* and the second detergent receiving portion 230*b*, respectively, including the first detergent space portion 238*a* and the second detergent space portion 238*b*.

As described above, a lower surface of the detergent space portion 238, that is, a lower inner surface of the detergent receiving portion 230 may be inclined toward the rear side. In this case, detergent or softener received in the detergent space portion 238 may efficiently move toward the detergent outlet port 236.

Figure 9:
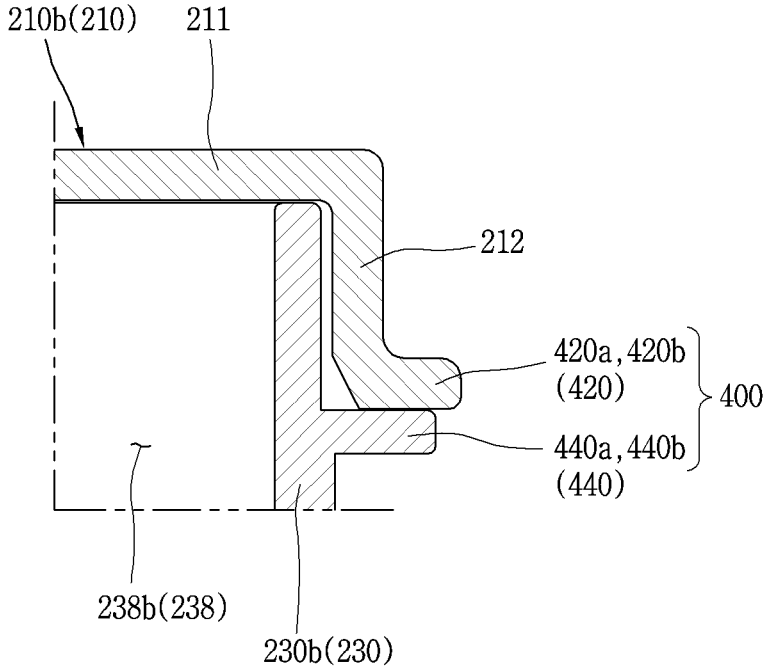
FIG. 9 is a cross-sectional view illustrating a detergent guide portion provided in the storage container in FIG. 7.
Figure 10:
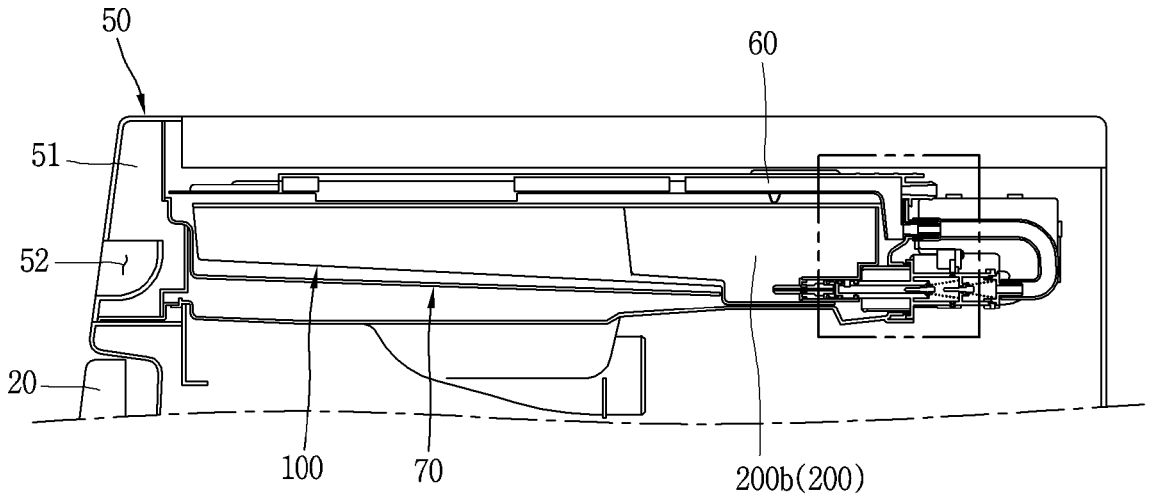
FIG. 10 is a cross-sectional view illustrating a detergent guide part provided in the storage container of FIG. 7.

Referring further FIGS. 9 and 10, the detergent receiving portion 230 includes a coupling protruding portion 239.

The coupling protruding portion 239 limits a moving distance in a downward direction of the cover portion 210 when the cover portion 210 is coupled to the detergent receiving portion 230. In other words, as an upper surface of the coupling protruding portion 239 is brought into contact with in contact with a lower end portion of the vertical surface portion 212 of the cover portion 210, a movement distance in the downward direction of the cover portion 210 is limited.

In addition, as the vertical surface portion 212 of the cover portion 210 is supported by the coupling protruding portion 239, the cover portion 210 and the detergent receiving portion 230 may be stably coupled to each other.

In the illustrated embodiment, the coupling protruding portion 239 is disposed to protrude horizontally from both sides of the detergent receiving portion 230. Alternatively, the coupling protruding portion 239 may be disposed to protrude at a predetermined angle with a side surface of the detergent receiving portion 230.

4. Description of Detergent Guide Portion 218 Provided in Detergent Supply Device 50 According to Embodiment of Present Disclosure The detergent supply device 50 according to an embodiment of the present disclosure includes a detergent guide portion 218 for preventing detergent from remaining in the frame 100.

Hereinafter, the detergent guide portion 218 according to an embodiment of the present disclosure will be described in detail with reference to FIGS. 9 through 13.

(1) Description of Detergent Guide Portion 218 According to Embodiment of Present Disclosure Referring to FIGS. 9 and 10, the cover portion 210 of the storage container 200 according to the illustrated embodiment includes the detergent guide portion 218.

The detergent guide portion 218 is configured to cover an upper surface of the partition wall portion 110 adjacent to the storage container 200 after the storage container 200 is inserted into and coupled to the container receiving portion 120 of the frame 100.

To this end, the detergent guide portion 218 may be provided at a side adjacent to the partition wall portion 110 of the storage container 200 inserted into the container receiving portion 120, that is, a side facing the partition wall portion 110.

The detergent guide portion 218 includes a first protruding portion 218*a* that protrudes horizontally from the flat portion 211 of the cover portion 210.

In the illustrated embodiment, the detergent guide portion 218 is disposed to protrude outward horizontally from an end portion where the flat portion 211 and the vertical surface portion 212 of the cover portion 210 are in contact with each other. In other words, the detergent guide portion 218 is disposed to protrude so as to be located on the same plane as the flat portion 211.

The detergent guide portion 218 is configured to cover an upper surface of the partition wall portion 110. In other words, the first protruding portion 218*a* of the detergent guide portion 218 is configured to cover an upper surface of the partition wall portion 110.

Preferably, the detergent guide portion 218 may be disposed to completely cover an upper surface of the partition wall portion 110 or cover an upper surface of the partition wall portion 110 and protrude further toward the first input opening portion 130.

A protruding distance of the detergent guide portion 218 is preferably defined as at least a distance capable of completely covering an upper surface of the partition wall portion 110.

An embodiment illustrated in FIG. 9 illustrates a left-right cross-sectional view of a state in which the first storage container 200*a* is inserted into the first container receiving portion 120*a*. Although not shown, it will be understood that the second structure 200*b* may have the same structure even when inserted into the second receiving portion 120*b*.

When the first storage container 200*a* is received in the first container receiving portion 120*a*, the vertical surface portion 212 of the first cover portion 210*a* located at an upper side of the first detergent receiving portion 230*a* is located adjacent to the first partition wall 110*a*. Specifically, the vertical surface portion 212 is located adjacent to one side of the first partition wall portion 110*a* adjacent to the first storage container 200*a*.

At this time, when the vertical surface portion 212 is not in close contact with the first partition wall portion 110*a*, there may exist a space in which detergent or softener flows between the vertical surface portion 212 and the first partition wall portion 110*a*.

Even when the vertical surface portion 212 and the first partition wall portion 110*a* are in close contact with each other, fine detergent powder or softener may flow between the vertical surface portion 212 and the first partition wall portion 110*a*.

The detergent guide portion 218 protruding from the first cover portion 210*a* is configured to cover an upper surface of the first partition wall portion 110*a*.

Therefore, even when a space exists between the vertical surface portion 212 and the first partition wall portion 110*a*, detergent or softener released from an upper side of the first cover portion 210*a* does not flow into the space.

In addition, in the illustrated embodiment, an outer upper surface of the detergent guide portion 218, that is, one upper surface facing the first partition wall portion 110*a* is defined in a rounded manner.

As a result, even when detergent or softener is released to an edge portion of the detergent guide portion 218, the detergent or softener efficiently flows into the first input opening portion 130 by the shape of the edge portion of the detergent guide portion 218 that is defined in a rounded manner.

An embodiment illustrated in FIG. 10 illustrates a front-rear cross-sectional view of a state in which the first storage container 200*a* is inserted into the first container receiving portion 120*a*. Although not shown, it will be understood that the second structure 200*b* may have the same structure even when inserted into the second receiving portion 120*b*.

When the first storage container 200*a* is received in the first container receiving portion 120*a*, the vertical surface portion 212 of the first cover portion 210*a* located at an upper side of the first detergent receiving portion 230*a* is located adjacent to the third partition wall 110*c*.

At this time, when the vertical surface portion 212 is not in close contact with the third partition wall portion 110*c*, there may exist a space in which detergent or softener flows between the vertical surface portion 212 and the third partition wall portion 110*c*.

Even when the vertical surface portion 212 and the third partition wall portion 110*c* are in close contact with each other, fine detergent powder or softener may flow between the vertical surface portion 212 and the third partition wall portion 110*c*.

The detergent guide portion 218 protruding from the first cover portion 210*a* is configured to cover at least part of an upper surface of the third partition wall portion 110*c*.

Therefore, even when a space exists between the vertical surface portion 212 and the third partition wall portion 110*c*, detergent or softener released from an upper side of the first cover portion 210*a* does not flow into the space.

In addition, in the illustrated embodiment, the outer upper surface of the detergent guide portion 218, that is, the upper surface of one side of the first protruding portion 218*a* facing the third partition wall portion 110*c* is rounded.

As a result, even when detergent or softener is released to an edge portion of the detergent guide portion 218, the detergent or softener efficiently flows into the first input opening portion 130 by the shape of the edge portion of the detergent guide portion 218 that is defined in a rounded manner.

As described above, the vertical surface portion 212 of the cover portion 210 is configured to define an outer side surface of the cover portion 210. In other words, the vertical surface portion 212 extends downward from all edges of the flat portion 211 of the cover portion 210.

In other words, an upper surface of both the first partition wall portion 110*a* and the third partition wall portion 110*c* to be brought into contact with the first storage container 200*a* may be covered by the detergent guide portion 218 provided in the first cover portion 210*a*.

As a result, no detergent or softener flows into a space between the first partition wall portion 110*a* and the third partition wall portion 110*c* and the vertical surface portion 212.

Similarly, although not shown, the above-described detergent guide portion 218 is also provided in the second cover portion 210*b* of the second storage container 200*b*.

The detergent guide portion 218 provided in the second cover portion 210*b* is configured to cover at least part of the remainder of the third partition wall portion 110*c* and an upper surface of the second partition wall portion 110*b*.

Preferably, the upper surface of the second partition wall portion 110*b* may be all covered by the detergent guide portion 218 provided in the first cover portion 210*a* and the detergent guide portion 218 provided in the second cover portion 210*b*.

Accordingly, an upper surface of the second partition wall portion 110*b* and the third partition wall portion 110*c* to be brought into contact with the second storage container 200*b* received in the second container receiving portion 120*b* may be covered by the detergent guide portion 218 provided in the second cover portion 210*b*.

As a result, no detergent or softener flows into a space between the second partition wall portion 110*b* and the third partition wall portion 110*c*, and the vertical surface portion 212.

Figure 11:
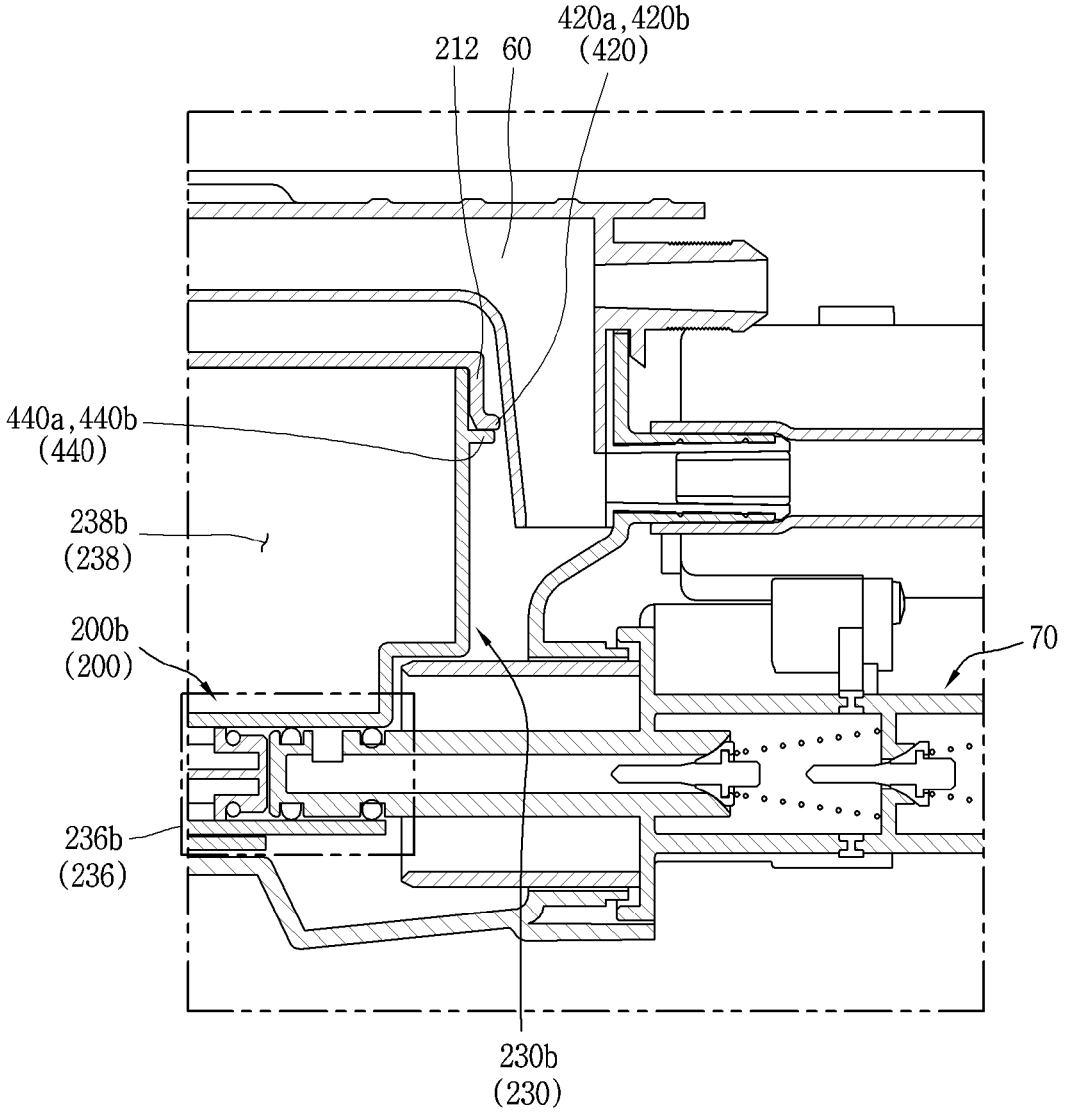
FIG. 11 is a cross-sectional view illustrating a clothes treating machine according to another embodiment of the present disclosure.

(2) Description of Detergent Guide Portion 218 According to Another Embodiment of Present Disclosure Referring to FIG. 11, the detergent guide portion 218 according to another embodiment of the present disclosure further includes the first protruding portion 218*a* and the second protruding portion 218*b* described above.

As described above, the first protruding portion 218*a* is disposed to protrude outward horizontally from an end portion where the flat portion 211 and the vertical surface portion 212 of the cover portion 210 are in contact with each other. The first protruding portion 218*a* is configured to cover an upper surface of the partition wall portion 110.

The second protruding portion 218*b* is disposed to protrude from an end portion of the first protruding portion 218*a* at a predetermined angle with the first protruding portion 218*a* in a downward direction. The second protruding portion 218*b* is configured to cover one surface of the partition wall portion 110, that is, a surface opposite to one surface of the partition wall portion 110 adjacent to the storage container 200.

A partition wall insertion opening portion 217 having an open lower side is disposed between the first protruding portion 218*a* and the second protruding portion 218*b*, and the vertical surface portion 212.

Therefore, in an embodiment illustrated in FIG. 11, the cover portion 210 includes a flat portion 211 and a first protruding portion 218*a* extending horizontally, and includes a vertical surface portion 212 extending downward from an end portion where the flat portion 211 and the first protruding portion 218*a* are in contact with each other and a second protruding portion 218*b* extending downward from the first protruding portion 218*a*.

In other words, the cover portion 210 has a "F" shape rotated by 90 degrees in a clockwise direction.

In the present embodiment, when the storage container 200 is inserted into the container receiving portion 120, the vertical surface portion 212 is located adjacent to the partition wall portion 110.

At this time, the first protruding portion 218*a* of the detergent guide portion 218 covers an upper surface of the partition wall portion 110. Furthermore, the second protruding portion 218*b* is disposed adjacent to an opposite side facing one side of the partition wall portion 110 adjacent to the vertical surface portion 212.

In other words, in the present embodiment, the partition wall portion 110 is inserted into the partition wall insertion opening portion 217. As a result, a space between the partition wall portion 110 and the vertical surface portion 212 is not exposed to the outside.

In addition, in the illustrated embodiment, an outer upper surface of the detergent guide portion 218, that is, one upper surface facing the third partition wall portion 110*c* at an end portion where the first protruding portion 218*a* and the second protruding portion 218*b* are in contact with each other is defined in a rounded manner.

As a result, even when detergent or softener is released to an edge portion of the detergent guide portion 218, the detergent or softener efficiently flows into the first input opening portion 130 by the shape of the edge portion of the detergent guide portion 218 that is defined in a rounded manner.

As described above, the input speed adjusting plate 132 may be provided in the first input opening portion 130. In this case, a groove (not shown) in which the input speed adjusting plate 132 is inserted is preferably disposed in the second protruding portion 218*b*.

FIG. 11 illustrates a case where the first storage container 200*a* received in the first container receiving portion 120*a* is located adjacent to the first partition wall portion 110*a*, but it will be understood that the inflow of detergent or softener can be prevented through the foregoing process even in case where the first storage container 200*a* is located adjacent to in the second partition wall portion 110*b* and the third partition wall portion 110*c*.

Moreover, it will be understood that the inflow of detergent or softener can be prevented through the foregoing process even in case of the first partition wall portion 110*a*, the second partition wall portion 110*b*, and the third partition wall portion 110*c*, which are located adjacent to the second storage container 200*b* received in the second container receiving portion 120*b*.

Figure 22:
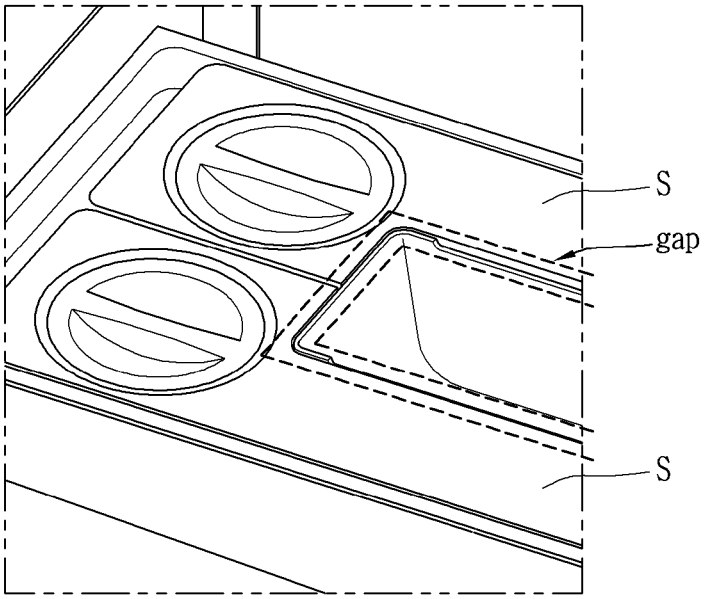
FIG. 22 is a perspective view illustrating a detergent supply device according to the related art.

(3) Description of Effect of Detergent Guide Portion 218 According to Embodiment of Present Disclosure In order to more clearly understand the effect of the detergent guide portion 218 according to an embodiment of the present disclosure, the problem of a detergent input device according to the related art illustrated in FIG. 22 will be described first.

The detergent input device according to the related art includes a detergent receiving member (S) for receiving detergent or softener. The detergent receiving member (S) may be inserted into a space defined in the detergent input device.

Furthermore, adjacent to the detergent receiving member (S), an opening portion through which detergent or softener can be added is additionally defined.

When the user puts detergent or softener into the opening portion, the detergent or softener may be scattered at a position deviating from the opening portion due to an immature operation or the like. In this case, the detergent or softener may flow into a gap defined between the detergent receiving member (S) and the opening portion.

In this case, the detergent or softener may be remained in or stuck to the gap. This is not only aesthetically pleasing, but may also be contaminated with the stuck detergent or softener, thereby adversely affecting hygiene.

The detergent guide portion 218 according to an embodiment of the present disclosure may prevent detergent or softener scattered due to an immature operation of the user from remaining in the detergent supply device 50.

Hereinafter, the effect of the detergent guide portion 218 according to an embodiment of the present disclosure will be described in detail with reference to FIGS. 12 and 13.

Figure 12:
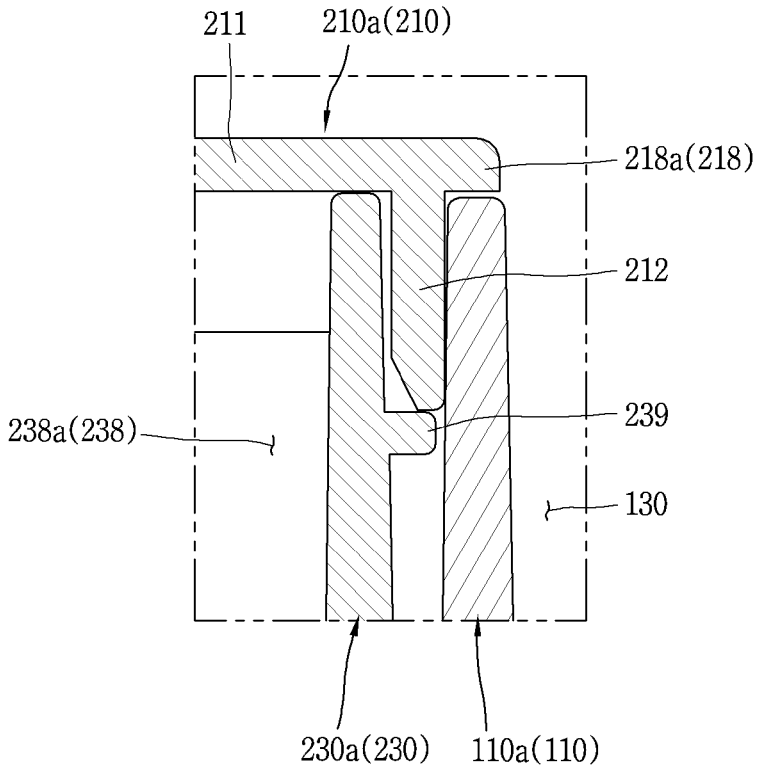
FIG. 12 is a cross-sectional view illustrating a process of preventing detergent from being introduced by the detergent guide portion in FIG. 9.

FIG. 12 illustrates a process in which detergent or softener does not flow into the space from the storage container 200 including the detergent guide portion 218 according to the embodiment illustrated in FIG. 9.

Figure 13:
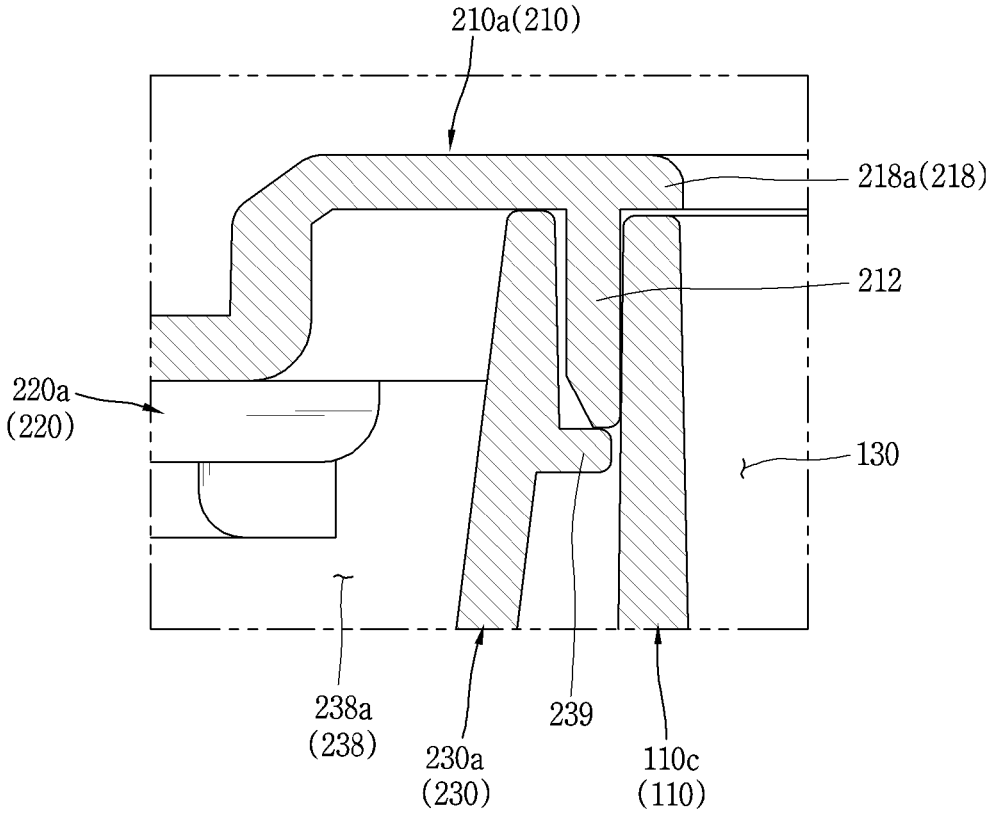
FIG. 13 is a cross-sectional view illustrating a process of preventing detergent from being introduced by the detergent guide portion in FIG. 10.

Furthermore, FIG. 13 illustrates a process in which detergent or softener does not into the space from the storage container 200 including the detergent guide portion 218 according to the embodiment illustrated in FIG. 10.

When the storage container 200 is received in the container receiving portion 120, one side of the storage container 200 is located adjacent to the partition wall portion 110.

Specifically, the vertical surface portion 212 of the cover portion 210 is located between the detergent receiving portion 230 and the partition wall portion 110. At this time, one side of the vertical surface portion 212 may be in contact with the detergent receiving portion 230, and an opposite side of the vertical surface portion 212 may be in contact with the partition 110.

In addition, the first protruding portion 218*a* of the detergent guide portion 218 protruding outward from the flat portion 211 of the cover portion 210 is located to cover an upper surface of the partition wall portion 110.

When the user puts detergent or softener into the first input opening portion 130, part of the detergent or softener may not move toward the first input opening portion 130 but may move toward the cover portion 210.

At this time, the detergent or the softener moving toward the cover portion 210 does not enter a space between the vertical surface portion 212 and the partition wall portion 110 due to the first protruding portion 218*a* of the detergent guide portion 218. Thus, the detergent or softener remains on the flat portion 211 or hits the first protruding portion 218*a* of the detergent guide portion 218 and flows into the first inlet opening portion 130.

As described above, an upper edge of an outer end portion of the first protruding portion 218*a* may be defined in a rounded manner to allow the released detergent or softener to more efficiently enter the first input opening portion 130.

As a result, detergent or softener may be prevented from flowing into a space between the vertical surface portion 212 and the partition wall portion 110.

Although not shown in the drawing, detergent or softener may be prevented from flowing into a space between the vertical surface portion 212 and the partition wall portion 110 through the foregoing process even in an embodiment in which the detergent guide portion 218 includes the first protruding portion 218*a* and the second protruding portion 218*b*.

In the above embodiment, the second protruding portion 218*b* is disposed to partially surround the first input opening portion 130. As a result, foreign materials such as detergent or softener may be more effectively prevented from flowing into a space between the vertical surface portion 212 and the partition wall portion 110.

5. Description of Sag Preventing Member 300 According to Embodiment of the Present Disclosure The detergent supply device 50 and the clothes treating machine 1 according to an embodiment of the present disclosure includes a sag preventing member 300 for preventing the detergent supply device 50 from sagging downward subsequent to being discharged by a predetermined distance from the detergent supply device coupling portion 70 of the clothes treating machine 1.

Hereinafter, the sag preventing member 300 according to an embodiment of the present disclosure will be described in detail with reference to FIGS. 14 through 18.

In the illustrated embodiment, the sag preventing member 300 includes a sag prevention protruding portion 310 provided in the detergent supply device 50 and a sag prevention elastic portion 320 provided in the supply passage portion 60. As described above, the supply passage portion 60 may be located at an inner upper side of the detergent supply device coupling portion 70. Therefore, it may be said that the sag prevention elastic portion 320 is provided in the detergent supply device coupling portion 70.

The sag prevention protruding portion 310 is provided in the frame 100 of the detergent supply device 50 to prevent the detergent supply device 50 discharged from the detergent supply device coupling portion 70 by a predetermined distance from inclining downward.

A position at which the sag prevention protruding portion 310 is disposed will be described in detail as follows.

The detergent supply device 50 includes a grip portion 51 located at the front side and a frame 100 extending from the grip portion 51 to the rear side.

The frame 100 includes a sidewall portion 160, an inclined portion 170, and an insertion portion 180 defining left and right wall surfaces thereof.

The sidewall portion 160 includes a first sidewall portion 160*a* located at the left side and a second sidewall portion 160*b* located at the right side.

Furthermore, the inclined portion 170 includes a first inclined portion 170*a* located at the left side and a second inclined portion 170*b* located at the right side.

Moreover, the insertion portion 180 includes a first insertion portion 180*a* located at the left side and a second insertion portion 180*b* located at the right side.

The container receiving portion 120 in which the storage container 200 is received is disposed between the first sidewall portion 160*a*, the first inclined portion 170*a*, and the first insertion portion 180*a*, and the second sidewall portion 160*b*, the second inclined portion 170*b*, and the second insertion portion 180*b*.

The sag prevention protruding portion 310 protrudes upward from an upper surface of the sidewall portion 160 adjacent to a portion where the sidewall portion 160 and the inclined portion 170 are in contact with each other.

In the illustrated embodiment, the sag prevention protruding portion 310 extends along an upper surface of the sidewall portion 160. A rear end portion of the sag prevention protruding portion 310 is located adjacent to a portion where the sidewall portion 160 and the inclined portion 170 are in contact with each other.

The sag prevention protruding portion 310 may be disposed on at least one of the first sidewall portion 160*a* and the second sidewall portion 160*b*.

The sag prevention protruding portion 310 includes a first sag preventing surface 312, a second sag preventing surface 314, and a third sag preventing surface 316.

The first sag preventing surface 312 is located at the foremost side of the sag prevention protruding portion 310. In the illustrated embodiment, the first sag preventing surface 312 extends upward from an upper surface of the sidewall portion 160 at a predetermined angle with the upper surface of the sidewall portion 160.

In one embodiment, an angle between the first sag preventing surface 312 and the upper surface of the sidewall portion 160 may be an acute angle. In other words, the first sag preventing surface 312 is disposed to be inclined with respect to the upper surface of the sidewall portion 160.

As the first sag preventing surface 312 is configured to increase in height toward a rear side of the sidewall portion 160, the detergent supply device 50 inserted into the detergent supply device coupling portion 70 may be efficiently slid and discharged.

In addition, when the detergent supply device 50 is discharged by the above structure of the first sag preventing surface 312, the sag prevention elastic portion 320 may be efficiently compressed upward along the first sag preventing surface 312.

The first sag preventing surface 312 extends upward and rearward from an upper surface of the sidewall portion 160. In other words, the first sag preventing surface 312 extends from an upper surface of the sidewall portion 160 toward a portion where the sidewall portion 160 and the inclined portion 170 are in contact with each other.

The second sag preventing surface 314 extends from a rear end portion of the first sag preventing surface 312 at a predetermined angle with the first sag preventing surface 312. In one embodiment, the second sag preventing surface 314 may extend at an obtuse angle with the first sag preventing surface 312.

In the illustrated embodiment, the second sag preventing surface 314 is disposed in parallel to the upper surface of the sidewall portion 160. In other words, the second sag preventing surface 314 may be horizontally disposed.

An angle between the second sag preventing surface 314 and the upper surface of the sidewall portion 160 may be changed. However, it is sufficient if it is in contact with the sag prevention elastic portion 320 which will be described later, and the detergent supply device 50 is at an angle that may not sag downward.

The third sag preventing surface 316 extends from a rear end portion of the second sag preventing surface 314 at a predetermined angle with the second sag preventing surface 314. In one embodiment, the third sag preventing surface 316 may extend at an obtuse angle with the second sag preventing surface 314.

An angle between the first sag preventing surface 312 and the upper surface of the sidewall portion 160 and an angle between the third sag preventing surface 316 and the upper surface of the sidewall portion 160 may be the same. In other words, an angle between the first sag preventing surface 312 and the second sag preventing surface 314 and an angle between the third sag preventing surface 316 and the second sag preventing surface 314 may be the same.

A rear end portion of the third sag preventing surface 316, that is, an end portion of the third sag preventing surface 316 at a side facing an end portion in contact with the second sag preventing surface 314 may be located at a portion where the sidewall portion 160 and the inclined portion 170 are in contact with each other.

As the third sag preventing surface 316 is configured to have a lower height toward a rear side of the sidewall portion 160, the detergent supply device 50 may be efficiently slid and inserted into the detergent supply device coupling portion 70.

In addition, when the detergent supply device 50 is inserted by the above structure of the third sag preventing surface 316, the sag prevention elastic portion 320 may be efficiently compressed upward along the third sag preventing surface 316.

The shape of the sag prevention protruding portion 310 is not limited thereto, and at least part of a surface of the sag prevention protruding portion 310 may be any shape capable of being in contact with the sag prevention elastic portion 320 which will be described later.

In another embodiment that is not illustrated herein, the sag prevention protruding portion 310 may include a single surface protruding from an upper surface of the sidewall portion 160. The single surface may be in contact with the sag prevention elastic portion 320 which will be described later to prevent the detergent supply device 50 from inclining downward.

The sag prevention elastic portion 320 is brought into contact with the sag prevention protruding portion 310 to apply an elastic force to the sag prevention protruding portion 310, thereby preventing the detergent supply device 50 from inclining downward.

The sag prevention elastic portion 320 is located at the sag prevention opening portion 62 disposed at a front side of the supply passage portion 60. The sag prevention elastic portion 320 is disposed to bend in a downward direction of the supply passage portion 60 through the sag prevention opening portion 62.

As described above, the supply passage portion 60 is located at an inner upper side of the detergent supply device coupling portion 70. Therefore, when the detergent supply device 50 is coupled to the detergent supply device coupling portion 70, the supply passage portion 60 is located at an upper side of the detergent supply device coupling portion 70.

Accordingly, the sag prevention elastic portion 320 provided in the supply passage portion 60 is configured to apply an elastic force in a direction from the upper side to the lower side to the sag prevention protruding portion 310 disposed in the detergent supply device 50.

The sag prevention elastic portion 320 may be deformed in shape, and may be made of a material having a restoring force to return to an original shape from a deformed shape. In one embodiment, the sag prevention elastic portion 320 may be made of a material having elasticity.

The sag prevention elastic portion 320 includes a first sag prevention coupling portion 322, a curved portion 324, and a second sag prevention coupling portion 326.

The first sag prevention coupling portion 322 is a portion to which the sag prevention elastic portion 320 is coupled to a front side of the supply passage portion 60.

In the illustrated embodiment, the width of a portion (first portion) where the first sag prevention coupling portion 322 is in contact with the supply passage portion 60 is defined to larger than that of a portion (second portion) where the first sag prevention coupling portion 322 is connected to the curved portion 324.

Specifically, the width of the first portion is defined to be larger than that of the sag prevention opening portion 62, and the width of the second portion is defined to be equal to or smaller than that of the sag protection opening portion 62.

Accordingly, even when the first sag prevention coupling portion 322 is coupled to an upper side of the supply passage portion 60, and then the curved portion 324 is bent downward through the sag prevention opening portion 62 of the supply passage portion 60, the first sag prevention coupling portion 322 does not randomly move downward through the sag prevention opening portion 62.

The curved portion 324 is disposed to extend to bend at a predetermined angle to the second portion of the first sag prevention coupling portion 322, that is, a rear side of the first sag prevention coupling portion 322. The second sag prevention coupling portion 326 is disposed to extend from a rear end portion of the curved portion 324.

The curved portion 324 is bent downward through the sag prevention opening portion 62 of the supply passage portion 60. At this time, the curved portion 324 is preferably bent to the extent that the curved portion 324 can be brought into contact with the sag prevention protruding portion 310.

Specifically, the degree of curvature of the curved portion 324 is preferably defined to be in contact with an upper surface of the sidewall portion 160. In a state where the curved portion 324 is in contact with the upper surface of the sidewall portion 160, a small amount of elastic force may be stored in the sag prevention elastic portion 320, or the elastic force may not be stored.

The width of the curved portion 324 is preferably defined to be equal to or smaller than that of the sag prevention opening portion 62.

The curved portion 324 includes a first curved portion **324*a* and a second curved portion 324*b***.

The first curved portion **324*a* extends downward from a rear end portion of the first sag prevention coupling portion 322 at a predetermined angle with the first sag prevention coupling portion 322. In other words, the first curved portion 324*a* extends to bend downward at a front side of the supply passage portion 60**.

The second curved portion **324*b* extends upward from a rear end portion of the first curved portion 324*a* at a predetermined angle with the first curved portion 324*a*. In other words, the second curved portion 324*b* extends to bend upward at a rear side of the supply passage portion 60**.

The second sag prevention coupling portion 326 extends from a rear end portion of the second curved portion **324*b***.

The second sag prevention coupling portion 326 is a portion to which the sag prevention elastic portion 320 is coupled to a rear side of the supply passage portion 60.

In the illustrated embodiment, the width of a portion (third portion) where the second sag prevention coupling portion 326 is in contact with the supply passage portion 60 is defined to larger than that of a portion (fourth portion) where the second sag prevention coupling portion 326 is connected to the curved portion 324.

Specifically, the width of the third portion is defined to be equal to or smaller than that of the sag prevention opening portion 62, and the width of the fourth portion is defined to be larger than that of the sag protection opening portion 62.

Accordingly, even when the second sag prevention coupling portion 326 is coupled to an upper side of the supply passage portion 60, and then the curved portion 324 is bent downward through the sag prevention opening portion 62 of the supply passage portion 60, the second sag prevention coupling portion 326 does not randomly move downward through the sag prevention opening portion 62.

Therefore, for the sag prevention elastic portion 320, the first sag prevention coupling portion 322 and the second sag prevention coupling portion 326 are located on an upper surface of the supply passage portion 60, and the curved portion 324 is located to be lower than the upper surface of the supply passage portion 60 through the sag prevention opening portion 62 of the supply passage portion 60.

The sag prevention elastic portion 320 may be detachably coupled to the supply passage portion 60. In other words, the sag prevention elastic portion 320 is separably coupled to the supply passage portion 60. Therefore, when an elastic force of the sag prevention elastic portion 320 is reduced, it may be possible to prevent the detergent supply device 50 from sagging downward only by replacing the sag prevention elastic portion 320.

Figure 18:
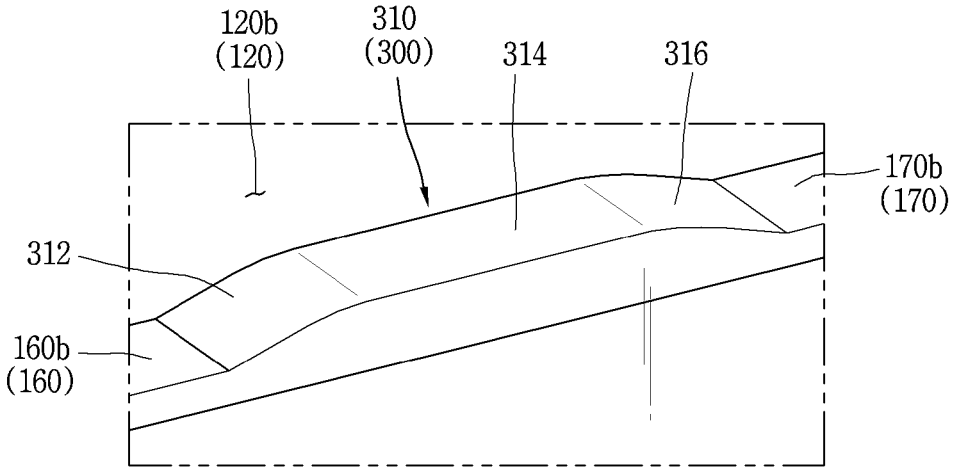
FIG. 18 is a cross-sectional view illustrating a state in which the sagging of the detergent supply device is prevented by the sag prevention protruding portion in FIG. 15 and the sag prevention elastic portion in FIG. 16.

The process of preventing the sagging of the detergent supply device 50 by the sag preventing member 300 will be described with reference to FIG. 18.

The detergent supply device 50 may be coupled to the detergent supply device coupling portion 70, and then slid and discharged from the detergent supply device coupling portion 70.

Figure 5:
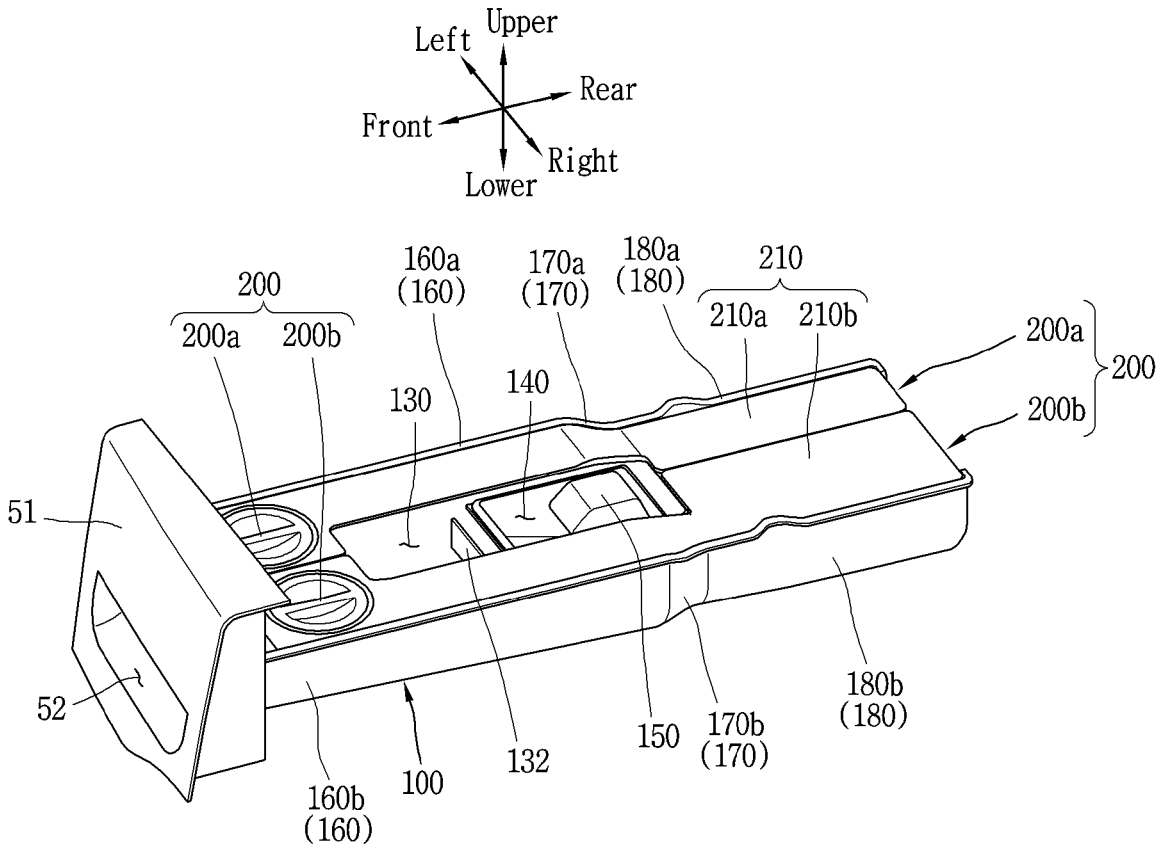
FIG. 5 is a perspective view of the detergent supply device in FIG. 4.
Figure 6:
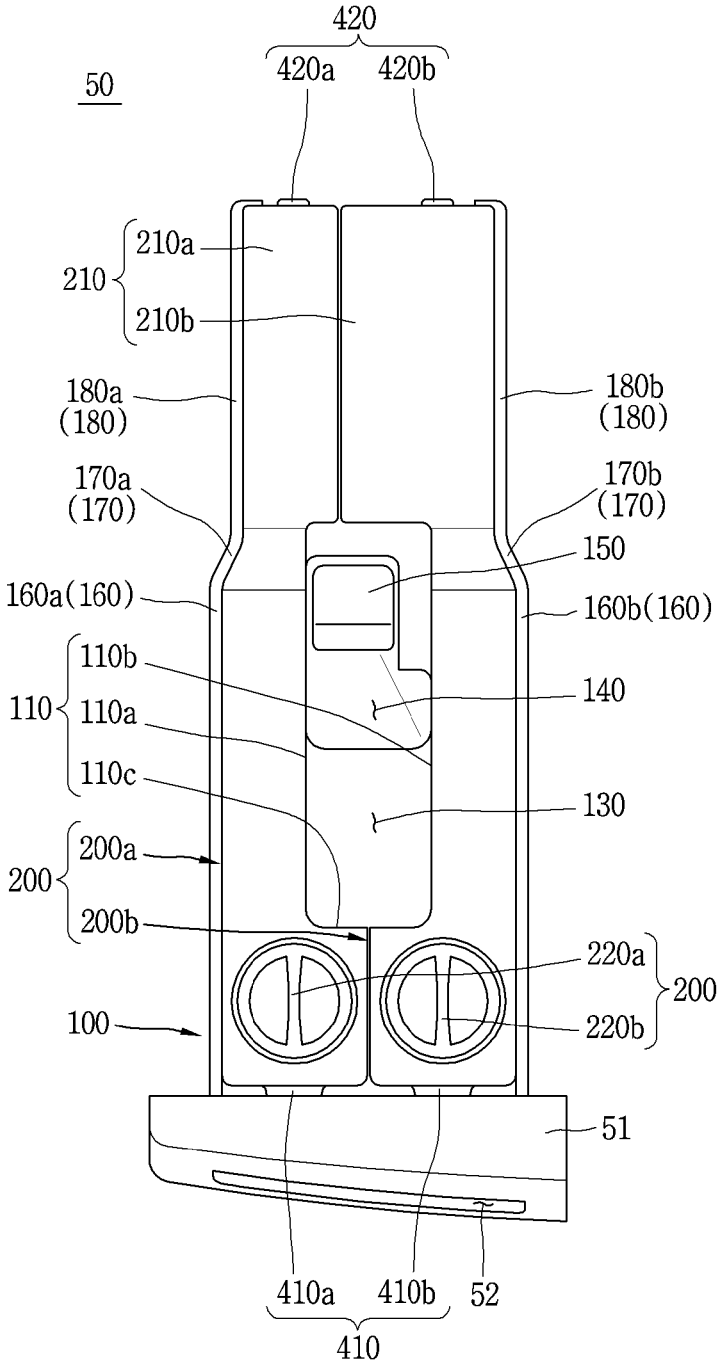
FIG. 6 is a plan view of the detergent supply device in FIG. 4.
Figure 7:
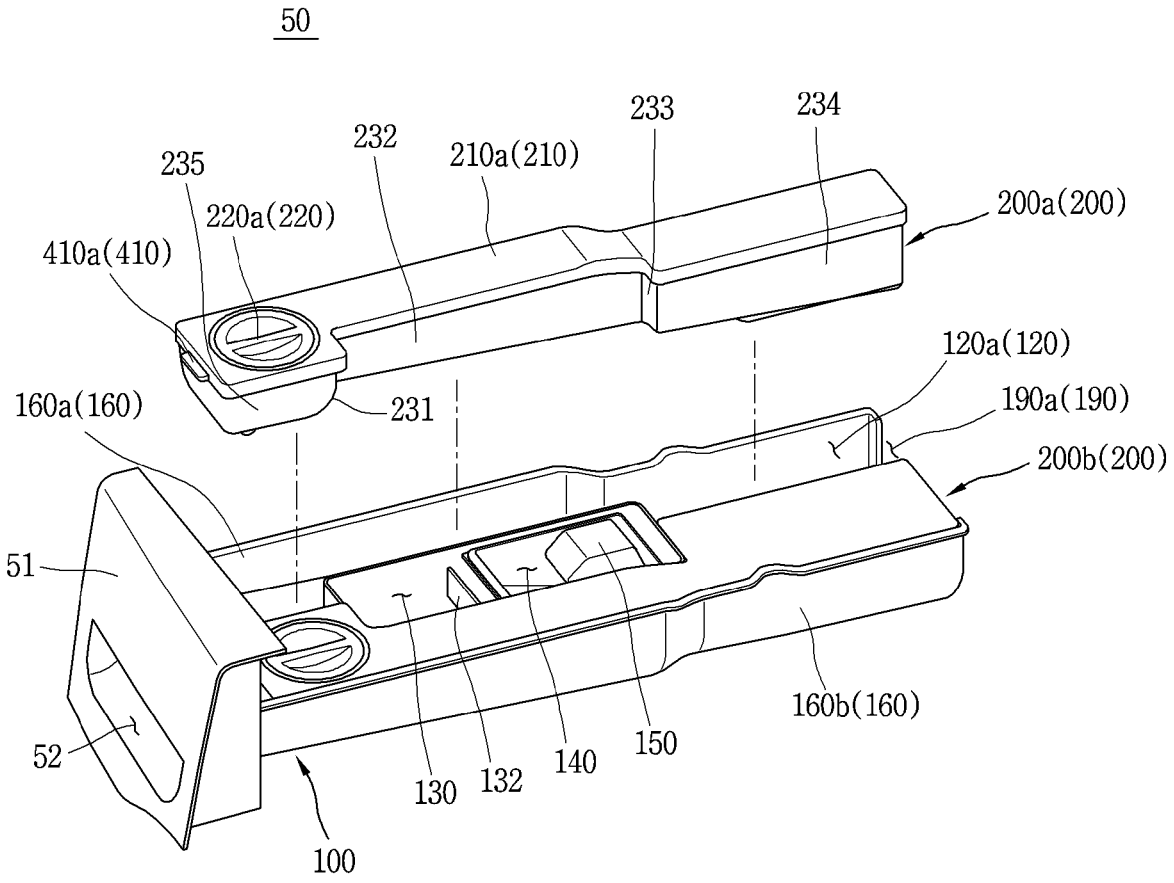
FIG. 7 is a perspective view illustrating a state in which a storage container is inserted into the detergent supply device in FIG. 5.
Figure 8:
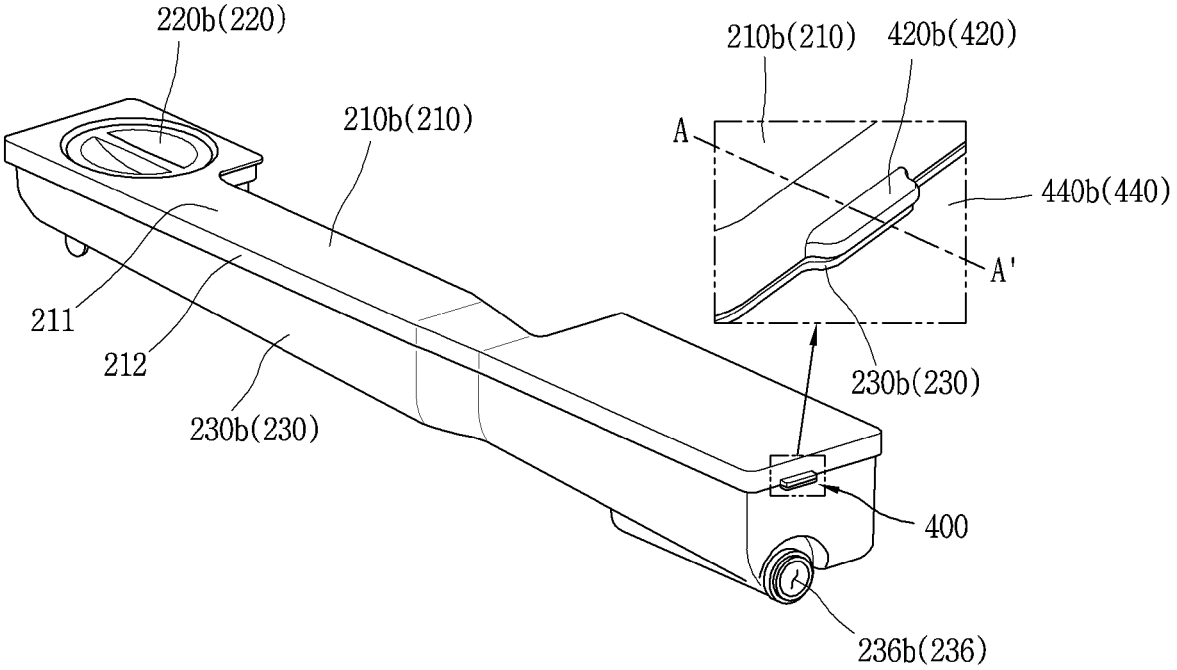
FIG. 8 is a perspective view of the storage container in FIG. 7.

At this time, when the detergent supply device 50 is slid and discharged by a predetermined distance, the release preventing portion 150 is brought into contact with a release preventing member (not shown) provided in the detergent supply device coupling portion 70 or the supply passage portion 60 (see FIGS. 4 and 5).

Accordingly, the detergent supply device 50 may be no longer slid and discharged.

At this position, the sag prevention protruding portion 310 provided in the sidewall portion 160 and the sag prevention elastic portion 320 provided in the supply passage portion 60 are in contact with each other.

In other words, a predetermined distance by which the detergent supply device 50 described above is discharged from the detergent supply device coupling portion 70 becomes a distance by which the sag prevention protruding portion 310 of the detergent supply device 50 and the sag prevention elastic portion 320 of the supply passage portion 60 can be in contact with each other.

The detergent supply device 50 tends to be inclined downward by the weight of the grip portion 51 provided at a front side of the detergent supply device 50 and the weight of the frame 100 located at a front side of the sag prevention protruding portion 310.

At this time, since the frame 100 is made of a synthetic resin or the like with no elasticity, and by the above weight, the detergent supply device 50 is rotated about a front lower end portion of the detergent supply device 50 and a front lower end portion of the detergent supply device coupling portion 70 as an axis.

Accordingly, the sag prevention protruding portion 310 presses the sag prevention elastic portion 320 upward.

As described above, the sagging prevention elastic portion 320 is made of a material having a restoring force such as elasticity. In addition, a restoring force stored in the sag prevention elastic portion 320 is minimized in a state where the curved portion 324 of the sag prevention elastic portion 320 is in contact with an upper surface of the sidewall portion 160 or is located adjacent to the upper surface.

In other words, as the discharge of the detergent supply device 50 is carried out, the elastic force stored in the sag prevention elastic portion 320 is gradually increased in the process of allowing the sag prevention elastic portion 320 to be sequentially brought into contact with the first sag preventing surface 312 and the second sag preventing surface 314 of the sag prevention protruding portion 310.

In other words, an elastic force applied by the sag prevention elastic portion 320 to the sag prevention protruding portion 310 is minimized in a state where the detergent supply device 50 is inserted into the detergent supply device coupling portion 70 such that the curved portion 324 of the sag prevention elastic portion 320 is in contact with or adjacent to the upper surface of the sidewall portion 160.

Furthermore, as the discharge of the detergent supply device 50 is carried out, an elastic force applied to the sag prevention protruding portion 310 by the sag prevention elastic portion 320 is gradually increased while the curved portion 324 of the sag prevention elastic portion 320 is brought into contact with the first sag preventing surface 312 and the second sag preventing surface 314.

In other words, when the curved portion 324 of the sag prevention elastic portion 320 is brought into contact with the second sag preventing surface 314, the elastic force applied to the sag prevention protruding portion 310 by the sag prevention elastic portion 320 is maximized.

Accordingly, the sag prevention elastic portion 320 applies an elastic force to the sag prevention protruding portion 310 in a direction opposite to a force applied by the sag prevention protruding portion 310, that is, a direction in which the sag prevention protruding portion 310 is pressed from the upper side to the lower side.

Accordingly, the sag prevention protruding portion 310 is unable to move upward so as not to rotate the detergent supply device 50.

As a result, the detergent supply device 50 may maintain a state of not being inclined downward.

The above-described process may also be applied to a process of inserting the detergent supply device 50 into the detergent supply device coupling portion 70.

In this case, as the insertion of the detergent supply device 50 is carried out, a restoring force stored in the sag prevention elastic portion 320 will increase gradually during a process in which the sag prevention elastic portion 320 is sequentially brought into contact with the third sag preventing surface 316 and the second sag preventing surface 314.

As a result, the detergent supply device 50 is not inclined downward even when the detergent supply device 50 is discharged by a predetermined distance to allow a user to supply detergent or softener, that is, a distance at which the release preventing portion 150 and the release preventing member (not shown) are brought into contact with each other so that the detergent supply device is no longer discharged or a distance at which the sag prevention protruding portion 310 and the sag prevention elastic portion 320 are in contact with each other.

6. Description of Storage Container Opening Member 400 According to Embodiment of Present Disclosure Referring to FIGS. 5, 8, and 19 through 21, the storage container 200 according to an embodiment of the present disclosure includes a storage container opening member 400.

As described above, the storage container 200 includes a detergent receiving portion 230 in which detergent or softener is received, and a cover portion 210 capable of opening or closing the detergent receiving portion 230.

At this time, the vertical surface portion 212 of the cover portion 210 is configured to be brought into contact with a side surface of the detergent receiving portion 230. In addition, an end portion where the flat portion 211 and the vertical surface portion 212 of the cover portion 210 are brought into contact with each other is defined to be flat without any additional protruding portion.

As described above, the cover portion 210 according to an embodiment of the present disclosure may include the detergent guide portion 218. However, the detergent guide portion 218 is disposed at one side of the cover portion 210 adjacent to the partition wall portion 110.

As a result, it is difficult for a user to move the cover portion 210 at a front side or a rear side of the storage container 200 to open the detergent receiving portion 230.

Specifically, the user must insert a nail or the like into a fine gap disposed between the vertical surface portion 212 of the cover portion 210 and the coupling protruding portion 239 of the detergent receiving portion 230, and then lift the cover portion 210 to open the detergent receiving portion 230.

The storage container 200 according to an embodiment of the present disclosure is provided with a storage container opening member 400, and configured to easily open the detergent receiving portion 230 without undergoing the above-mentioned inconvenience process.

The storage container opening member 400 is disposed to protrude from the front and rear sides of the storage container 200 to the front and rear sides thereof.

The storage container opening member 400 includes a cover front protruding portion 410, a cover rear protruding portion 420, a container front protruding portion 430, and a container rear protruding portion 440.

Furthermore, the storage container 200 according to an embodiment of the present disclosure includes a first storage container 200*a* and a second storage container 200*b*.

Accordingly, the first storage container 200*a* includes a first cover front protruding portion 410*a*, a first cover rear protruding portion 420*a*, a first container front protruding portion 430*a*, and a first container rear protruding portion 440*a*.

Similarly, the second storage container 200*b* includes a second cover front protruding portion 410*b*, a second cover rear protruding portion 420*b*, a second container front protruding portion 430*b*, and a second container rear protruding portion 440*b*.

Each of the first and second protruding portions 410*a*, 410*b*, 420*a*, 420*b*, 430*a*, 430*b*, 440*a*, 440*b* has the same structure and function. Therefore, in the following description, the cover front protruding portion 410, the cover rear protruding portion 420, the container front protruding portion 430, and the container rear protruding portion 440 will be described.

The cover front protruding portion 410 and the cover rear protruding portion 420 are disposed to protrude from the front and rear sides of the cover portion 210 to the front and rear sides thereof, respectively.

Figure 19:
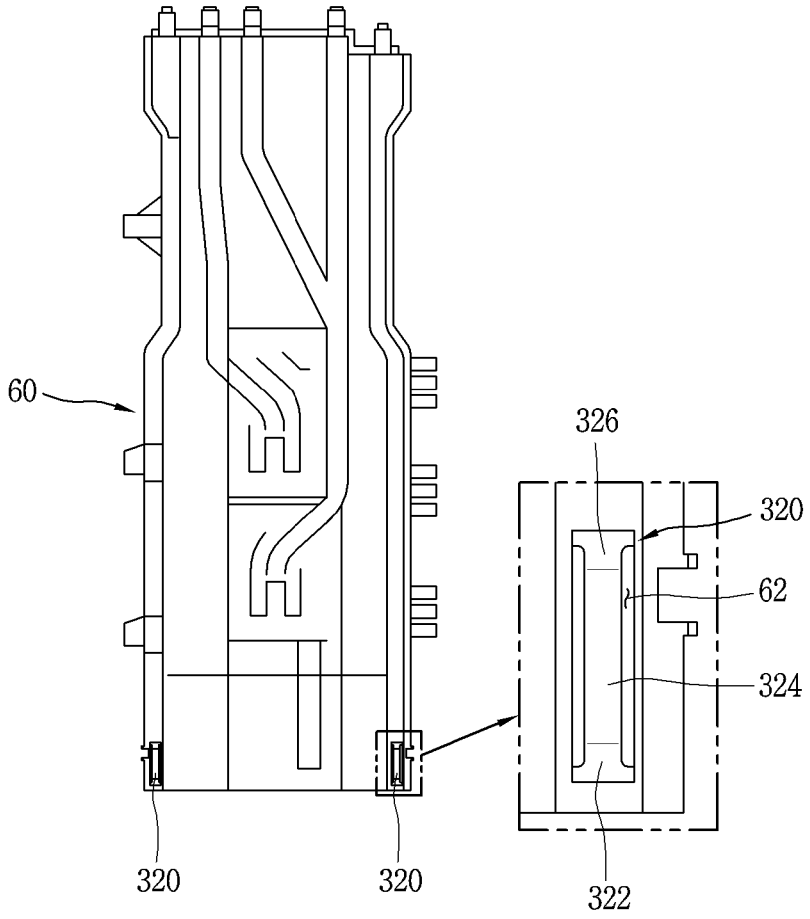
FIG. 19 is a cross-sectional view of a storage container opening member provided in the storage container in FIG. 7.

Although only the cover rear protruding portion 420 is illustrated in FIG. 19, the cover front protruding portion 410 may also be disposed in the same structure. Hereinafter, the cover rear protruding portion 420 will be described.

The cover rear protruding portion 420 is disposed to protrude from an end portion of the vertical surface portion 212 at a rear side of the cover portion 210 at an angle with the vertical surface portion 212.

In other words, the cover rear protruding portion 420 is disposed to protrude at a predetermined angle with the vertical surface portion 212 from an end portion where the vertical surface portion 212 is in contact with the coupling protruding portion 239 of the detergent receiving portion 230.

In one embodiment, the cover rear protruding portion 420 may protrude perpendicular to the vertical surface portion 212. In other words, the cover rear protruding portion 420 may protrude horizontally from the vertical surface portion 212 to the rear side.

A lower surface of the cover rear protruding portion 420 may be disposed to be in contact with an upper surface of the container rear protruding portion 440 which will be described later. Accordingly, a coupling between the cover portion 210 and the detergent receiving portion 230 may be maintained firmly.

A protruding distance of the cover rear protruding portion 420 is preferably defined to be a distance that is sufficient for the user to grip.

In the illustrated embodiment, the cover rear protruding portion 420 protrudes to have a larger distance than the container rear protruding portion 440 which will be described later. As a result, the user may easily open the detergent receiving portion 230 by gripping the cover rear protruding portion 420 and lifting the cover portion 210.

As described above, the gripping groove portion 190 is disposed at a rear side of the frame 100. The cover rear protruding portion 420 may be inserted through the gripping groove portion 190. Accordingly, the cover rear protruding portion 420 is not interfered by the frame 100.

Therefore, the storage container 200 including the cover rear protruding portion 420 may be efficiently inserted into the detergent receiving portion 230.

The cover front protruding portion 410 is disposed in the same structure as the cover rear protruding portion 420 except being disposed to protrude at a predetermined angle with the vertical surface portion 212 toward a rear side from an end portion of the vertical surface portion 212 at a front side of the cover portion 210.

The container front protruding portion 430 and the container rear protruding portion 440 are disposed to protrude from the front and rear sides of the detergent receiving portion 230 to the front and rear sides thereof, respectively.

Although only the container rear protruding portion 440 is illustrated in FIG. 19, the container front protruding portion 430 may also be disposed in the same structure. Hereinafter, the container rear protruding portion 440 will be mainly described.

The container rear protruding portion 440 is disposed to protrude from a rear side surface of the detergent receiving portion 230 in contact with the vertical surface portion 212 at a rear side of the cover portion 210 at a predetermined angle with the rear side surface of the detergent receiving portion 230.

In one embodiment, the container rear protruding portion 440 may protrude perpendicular to the rear side surface of the detergent receiving portion 230. In other words, the container rear protruding portion 440 may protrude horizontally from a rear side surface of the detergent receiving portion 230 to the rear side.

An upper side surface of the cover rear protruding portion 440 may be in contact with a lower side surface of the cover rear protruding portion 420. Accordingly, a coupling between the cover portion 210 and the detergent receiving portion 230 may be maintained firmly.

A protruding distance of the container rear protruding portion 440 is preferably defined to be a distance that is sufficient for the user to grip.

In the illustrated embodiment, the container rear protruding portion 440 protrudes to have a smaller distance than the cover rear protruding portion 420. As a result, the user may easily open the detergent receiving portion 230 by gripping the cover rear protruding portion 420 and lifting the cover portion 210.

In other words, assuming that the storage container 200 is separated from the frame 100, the cover portion 210 is located at an upper side of the detergent receiving portion 230. Accordingly, the user will generally pull the cover portion 210 upward rather than pulling the detergent receiving portion 230 downward to separate the storage container 200.

Therefore, when a protruding distance of the cover rear protruding portion 420 relatively located at the upper side is disposed to be equal to or greater than that of the container rear protruding portion 440 relatively located at the lower side, the user's convenience may be increased.

As described above, the gripping groove portion 190 is disposed at a rear side of the frame 100. The container rear protruding portion 440 may be inserted through the gripping groove portion 190. As a result, the container rear protruding portion 440 is not interfered by the frame 100.

Therefore, the storage container 200 including the container rear protruding portion 440 may be efficiently inserted into the detergent receiving portion 230.

The container front protruding portion 430 is disposed to have the same structure as the container rear protruding portion 440 except that the container front protruding portion 430 is disposed to protrude toward the front side at a predetermined angle with a front side surface of the detergent receiving portion 230 from the front side surface of the detergent receiving portion 230.

In case of the cover front protruding portion 410 and the container front protruding portion 430 of the storage container opening member 400 described above, the protruding distance is not largely limited because an additional member is not provided at a front side of the frame 100.

However, the detergent supply device 50 is coupled to the detergent supply device coupling portion 70, and then various members such as a passage defining member are located at a rear side of the frame 100. As a result, in case of the cover rear protruding portion 420 and the container rear protruding portion 440, the protruding distance must be limited.

Figure 20:
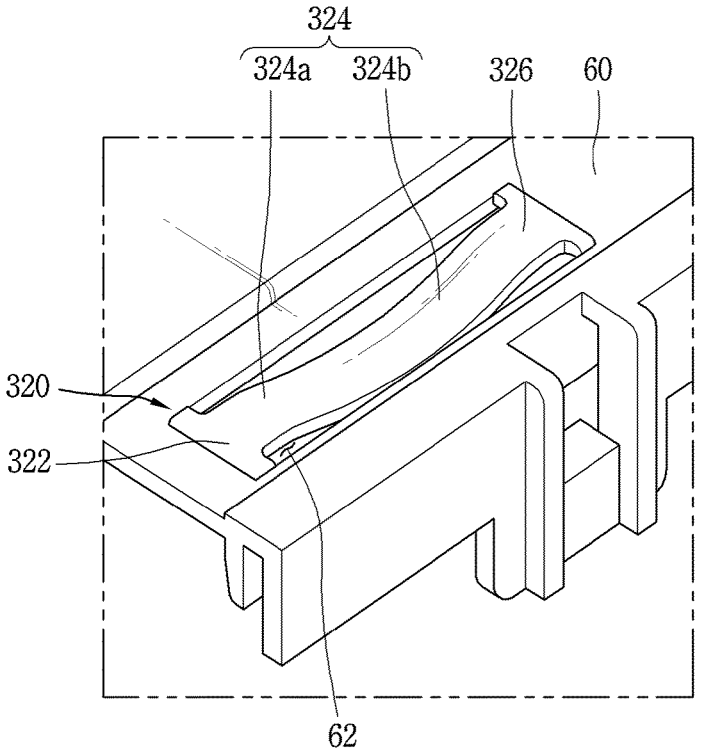
FIG. 20 is a cross-sectional view illustrating a state in which a detergent receiving portion in FIG. 4 is coupled to the clothes treating machine in FIG. 1.
Figure 21:
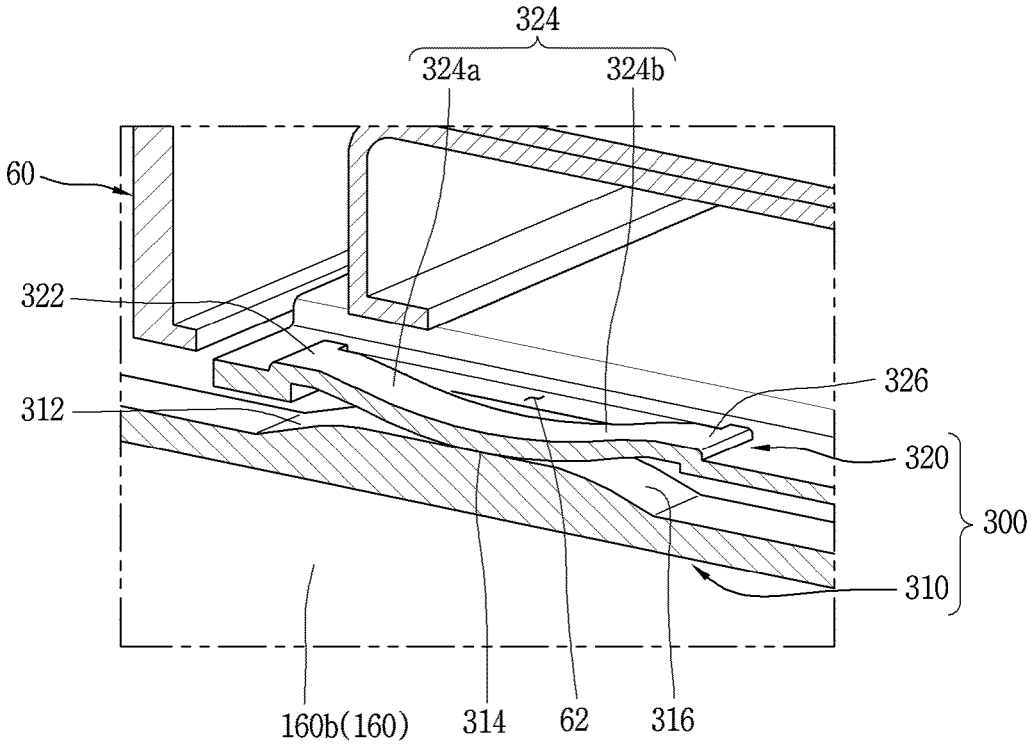
FIG. 21 is a cross-sectional view showing the position of a storage container opening member when the detergent receiving portion in FIG. 4 is coupled to the clothes treating machine in FIG. 1.

Referring to FIGS. 20 and 21, it is illustrated a cross-sectional view of the detergent supply device 50 coupled to the detergent supply device coupling portion 70 while the storage container 200 having the storage container opening member 400 is inserted therein.

The cover rear protruding portion 420 and the container rear protruding portion 440 disposed at a rear side of the storage container 200 protrude toward a rear side of the frame 100 by the gripping groove portion 190 described above.

At this time, the cover rear protruding portion 420 and the container rear protruding portion 440 are preferably not brought into contact with the supply passage portion 60 located at a rear side of the frame 100.

In other words, a protruding distance of the cover rear protruding portion 420 and the container rear protruding portion 440 is preferably disposed to be smaller than a distance between a rear side surface of the cover portion 210 and a front side surface of the supply passage portion 60 facing the rear side surface of the cover portion 210.

As a result, even when the storage container opening member 400 is provided, interruption with other members received in the clothes treating machine 1 may not occur.

Though it is described above with reference to preferred embodiments, various modifications and improvements will become apparent to those skilled in the art without departing from the concept and scope of the present disclosure as disclosed in the following claims.

What is claimed is:

1. A detergent supply device for a clothes treating machine, the detergent supply device comprising:

a storage container; and a frame configured to receive the storage container and configured to be slidably inserted into the clothes treating machine or discharged from the clothes treating machine, wherein the storage container comprises:

a detergent receiving portion that extends in a length direction of the storage container and that is configured to receive detergent or softener therein, and a cover portion configured to open and close the detergent receiving portion, the cover portion comprising a cover rear protruding portion that protrudes from a first side of the cover portion in the length direction and that is configured to be gripped by a user to open the detergent receiving portion.

2. The detergent supply device of claim 1, wherein the detergent receiving portion comprises a container rear protruding portion that protrudes in the length direction from a first side of the detergent receiving portion corresponding to the first side of the cover portion, wherein the cover rear protruding portion and the container rear protruding portion are configured to face each other, and wherein the cover rear protruding portion protrudes rearward relative to the container rear protruding portion.

3. The detergent supply device of claim 1, wherein the cover portion further comprises:

a flat portion configured to cover the detergent receiving portion; and a vertical surface portion that extends downward from an end portion of the flat portion, and wherein the cover rear protruding portion protrudes in the length direction from the vertical surface portion.

4. The detergent supply device of claim 1, wherein the cover portion further comprises:

a cover front protruding portion that protrudes forward along the length direction from a second side of the cover portion opposite to the first side, the cover front protruding portion being configured to be gripped by the user to open the detergent receiving portion.

5. The detergent supply device of claim 4, wherein the detergent receiving portion further comprises:

a container front protruding portion that protrudes forward along the length direction from a second side of the detergent receiving portion opposite to the first side of the detergent receiving portion, the cover front protruding portion being configured to be gripped by the user to open the detergent receiving portion.

6. A detergent supply device for a clothes treating machine, the detergent supply device comprising:

a storage container comprising:

a detergent receiving portion that extends in a length direction of the storage container and that is configured to receive detergent or softener therein, and a cover portion configured to open and close the detergent receiving portion; and a frame that is configured to receive the storage container and that is configured to be slidably inserted into the clothes treating machine or discharged from the clothes treating machine, wherein the cover portion comprises a cover rear protruding portion that protrudes in the length direction from a first side of the cover portion and that is configured to be gripped by a user to open the detergent receiving portion, and wherein the detergent receiving portion comprises a container rear protruding portion that protrudes in the length direction from a first side of the detergent receiving portion corresponding to the first side of the cover portion and that is configured to be gripped by a user to open the detergent receiving portion.

7. The detergent supply device of claim 6, wherein the frame defines a gripping groove at a side corresponding to the first side of the cover portion, the gripping groove being configured to expose the cover rear protruding portion and the container rear protruding portion based on the storage container being received in the frame.

8. The detergent supply device of claim 7, wherein the gripping groove comprises an opening defined at an upper side of the frame, and wherein the cover rear protruding portion and the container rear protruding portion are configured to be inserted into the gripping groove through the opening based on the storage container being received in the frame.

9. The detergent supply device of claim 6, wherein the cover rear protruding portion and the container rear protruding portion are configured to face each other based on the cover portion closing the detergent receiving portion.

10. The detergent supply device of claim 6, wherein the frame comprises:

a sidewall portion that defines at least a portion of a side surface of the detergent supply device and that extends in the length direction; and a sag prevention protruding portion disposed on an upper surface of the sidewall portion and configured to restrict downward movement of the frame based on the frame being discharged from the clothes treating machine by a predetermined distance.

11. The detergent supply device of claim 10, wherein the sag prevention protruding portion protrudes upward from the upper surface of the sidewall portion and is configured to contact an elastic portion disposed inside the clothes treating machine.

12. The detergent supply device of claim 6, wherein the frame comprises a partition wall portion that defines a container receiving portion configured receive the storage container and an input opening configured to receive detergent or softener, and wherein at least one side of the storage container is configured to face the partition wall portion based on the storage container being received in the container receiving portion of the frame.

13. The detergent supply device of claim 12, wherein the cover portion comprises:

a detergent guide portion that protrudes from one side of the cover portion toward the partition wall portion, that covers an upper surface of the partition wall portion, and that is configured to block detergent or softener entering from an upper side of the cover portion into a space defined between the storage container and the partition wall portion.

14. The detergent supply device of claim 13, wherein the detergent guide portion protrudes in a width direction of the storage container from the one side of the cover portion toward the partition wall portion, and extends downward to thereby cover at least a portion of an inner surface of the partition wall portion.

15. A clothes treating machine, comprising:

a housing;

a tub disposed inside the housing;

a drum disposed inside the tub and configured to rotate relative to the tub;

a detergent supply device configured to receive detergent or softener and supply the detergent or the softener to the tub; and a detergent supply device coupling portion configured to receive the detergent supply device, the detergent supply device being configured to slidably inserted into or discharged from the detergent supply device coupling portion, wherein the detergent supply device comprises:

a frame, and a storage container configured to be received in the frame, the storage container comprising a detergent receiving portion that extends in a length direction and that is configured to receive the detergent or the softener and a cover portion configured to open and close the detergent receiving portion, and wherein the cover portion comprises a cover rear protruding portion that protrudes in the length direction from one side of the cover portion and that is configured to be gripped by a user to open the detergent receiving portion.

16. The clothes treating machine of claim 15, wherein the frame defines a gripping groove at a side of the frame corresponding to the one side of the cover portion, the gripping groove being configured to expose the cover rear protruding portion based on the storage container being received in the frame.

17. The clothes treating machine of claim 16, wherein the gripping groove comprises an opening defined at an upper side of the frame, and wherein the cover rear protruding portion is configured to be inserted into the gripping groove through the opening based on the storage container being received in the frame.

18. The clothes treating machine of claim 15, wherein the detergent supply device coupling portion comprises:

an elastic portion that is configured to contact at least a portion of an upper surface of the frame to thereby restrict downward movement of the storage container based on the frame being discharged from the housing by a predetermined distance.

* * * * *